US009045975B2

(12) United States Patent
Tønnessen et al.

(10) Patent No.: US 9,045,975 B2
(45) Date of Patent: Jun. 2, 2015

(54) WELL TOOL AND METHOD FOR IN SITU INTRODUCTION OF A TREATMENT FLUID INTO AN ANNULUS IN A WELL

(75) Inventors: Sven Harald Tønnessen, Sandnes (NO); Bengt Gunnarsson, Hundvåg (NO); Arthur Herman Dybevik, Sandnes (NO); Jonathan Eugen Olsen, Sandnes (NO)

(73) Assignee: AGR CANNSEAL AS, Straume (NO)

( * ) Notice: Subject to any disclaimer, the term of this patent is extended or adjusted under 35 U.S.C. 154(b) by 646 days.

(21) Appl. No.: 13/378,555

(22) PCT Filed: Jun. 14, 2010

(86) PCT No.: PCT/NO2010/000227

§ 371 (c)(1),
(2), (4) Date: Dec. 15, 2011

(87) PCT Pub. No.: WO2010/147476

PCT Pub. Date: Dec. 23, 2010

(65) Prior Publication Data

US 2012/0085539 A1 Apr. 12, 2012

(30) Foreign Application Priority Data

Jun. 16, 2009 (NO) ..... 20092315

(51) Int. Cl.

| | |
|---|---|
| ***E21B 33/138*** | (2006.01) |
| ***E21B 43/11*** | (2006.01) |
| ***E21B 43/119*** | (2006.01) |
| ***E21B 43/117*** | (2006.01) |
| ***E21B 23/01*** | (2006.01) |
| ***E21B 27/02*** | (2006.01) |
| ***E21B 33/14*** | (2006.01) |

(52) U.S. Cl.

CPC ..... *E21B 43/117* (2013.01); *E21B 23/01* (2013.01); *E21B 27/02* (2013.01); *E21B 33/14* (2013.01); *E21B 43/119* (2013.01)

(58) Field of Classification Search

CPC ..... E21B 33/138; E21B 43/112; E21B 33/13; E21B 49/06; E21B 43/11; E21B 43/119; E21B 49/04

USPC ..... 166/297, 298, 100, 55.1; 175/2–4.6

See application file for complete search history.

(56) References Cited

U.S. PATENT DOCUMENTS 2,613,747 A * 10/1952 West ..... 166/100
3,430,711 A * 3/1969 Taggart ..... 175/4.52

(Continued)

FOREIGN PATENT DOCUMENTS

WO WO 03/072905 A1 9/2003
WO WO 2006/098634 A1 9/2006

*Primary Examiner* — Shane Bomar
*Assistant Examiner* — Kipp Wallace
(74) *Attorney, Agent, or Firm* — Foley & Lardner LLP

(57) ABSTRACT

A well tool (2; 302*a*, 302*b*) and method for in situ introduction of a treatment means (151) into a region of an annulus (12), comprising: an anchoring body (38; 338); a perforation device (234) for making a hole (236) through a pipe structure (4); a storage chamber (142*a*, 142*b*) for the treatment means (151); a driving means (132, 144, 150) for the treatment means (151); and a flow-through connection device (192) for injection of the treatment means (151). The distinctive characteristic is that the anchoring body (38; 338) is disposed in an anchoring module (18; 318); wherein the storage chamber (142*a*, 142*b*), the driving means (132, 144, 150) and the connection device (192) are operatively connected to an injection module (30; 330); wherein the injection module (30; 330) can be moved axially relative to the anchoring module (18; 318) for moving the connection device (192) in vicinity of the hole (236); and wherein the well tool (2; 302*a*, 302*b*) comprises at least one alignment means for alignment and connection of the connection device (192) vis-à-vis the hole (236).

14 Claims, 13 Drawing Sheets

(56) References Cited

U.S. PATENT DOCUMENTS 3,542,141 A * 11/1970 Voetter ..... 175/4.52
4,158,388 A 6/1979 Owen et al.
4,854,384 A * 8/1989 Campbell ..... 166/122
5,353,637 A * 10/1994 Plumb et al. ..... 73/152.17
7,562,710 B2 * 7/2009 Buchanan ..... 166/288
2009/0173500 A1 * 7/2009 Orban et al. ..... 166/298

* cited by examiner

WELL TOOL AND METHOD FOR IN SITU INTRODUCTION OF A TREATMENT FLUID INTO AN ANNULUS IN A WELL

TECHNICAL FIELD

The present invention concerns a well tool and a method for in situ introduction of a treatment fluid into any annulus in a subsurface well, for example a hydrocarbon well or an injection well. Moreover, this invention may be used in any type of well, including a vertical well, a deviation well, a multi-lateral well and a horizontal well. The invention is suitable for use both in uncased, open well bores and also in cased well bores.

This invention is especially suitable for remedial well operations during the completion phase of a well, i.e. the phase after the well has been completed and is in operation.

In this context, said treatment fluid may, for example, be comprised of a suitable sealing mass, for example fusible plastics, thermosetting plastics, epoxy, metal or other material of a suitable type. If the sealing mass is a solid-state material of the fusible type, the well tool should also comprise a heating device for melting the sealing mass before introduction into an annulus in a well. As an alternative or addition, the fusible sealing mass may be melted before conveyance into the well, after which it is kept in a molten state until introduction into said annulus.

As another example, the treatment fluid may be comprised of a well stimulation means, for example an acid, a liquid with a proppant material added thereto, a soluble material, a consolidation liquid, a scale inhibitor, etc.

BACKGROUND OF THE INVENTION

The background of this invention is problems and disadvantages associated with the prior art concerning introduction of a treatment fluid, for example a remedial seal, into an annulus in a well after completion of the well and during the operating phase thereof. It is emphasized, however, that the present invention may be used in any phase during the lifetime of a well.

With respect to remedial seals, and according to prior art, it is customary to use various well packers to isolate zones, for example one or more reservoir zones, along a well pipe when placed in, or being placed in, a well. Packers of this type are normally placed on the outside of the specific well pipe and before it is conveyed into the well. This type of packer is commonly referred to as an external casing packer—"ECP", for example a so-called inflatable packer. When the well pipe has been conveyed and is positioned at the corrected location in the well, the packer(s) is/are activated in the annulus around the well pipe and is/are forced outwards and against surrounding rocks, or against a surrounding well pipe. Activation of such a packer may be carried out hydraulically and/or mechanically. A so-called swell packer may also be used that will expand upon contact with, for example, oil and/or water in the well. Packer setting techniques of this type constitute prior art.

Yet further, during the post-completion phase of a well, and particularly in connection with recovery of hydrocarbons from a reservoir, production-related problems or conditions may arise that require or generate a need for installing one or more additional annulus packers in the well. Installation of such remedial annulus packers may form part of an appropriate production management strategy, water injection management strategy or reservoir drainage strategy. Alternatively, such an installation may be carried out to remedy an acute situation in the well. Accordingly, a need may exist for isolating one or more zones in a well, for example in a production well or in an injection well, and the need may arise at any time throughout the lifetime of a well. Normally, the need will be the greatest in horizontal wells and highly deviated wells. Deficient or failing zone isolation may restrain or prevent various efforts to stimulate the recovery from a well, which may reduce the recovery factor and profitability of the well and/or the reservoir. Insufficient zone isolation may also lead to unfortunate and/or dangerous conditions in the well. It may also concern other isolation/treatment needs in any annulus in a well, including an annulus between an uncased borehole wall and a well pipe, or an annulus between two well pipes. Thus it may concern, for example, a cemented annulus requiring after-treatment, or an annulus between two well pipes, along the entire length or longitudinal sections of the well.

The following examples point out some well conditions in which effective and selective annulus sealing may be of great significance to the performance of a well:

- Blocking of undesirable fluid flows, for example a water flow, from specific zones/intervals and into a production well, such as undesirable fluid flows from faults, fractures and highly permeable regions of surrounding rocks;
- Blocking of undesirable fluid flows to so-called "thief-zones" in an injection well, such as undesirable fluid flows to faults, fractures and highly permeable regions of surrounding rocks; and
- Selective placement of well treatment chemicals, including scale inhibitors and stimulation chemicals, in individual zones of a production well or injection well.

PRIOR ART AND DISADVANTAGES THEREOF

Use of external casing packers ("ECP's") as well as use of so-called gravel packs constitute two main techniques employed for zone isolation/zone control of annuli, particularly in open well bores. The methods may be used individually or in combination, and the purpose thereof is to seal an annulus completely (external casing packer) or to significantly restrict a fluid flow in the annulus (gravel pack). An external casing packer mau fail whilst being set or after being set in the annulus in the well, whereby the annulus is sealed in an unsatisfactory manner.

Employment of external casing packers and gravel packs, however, takes place before or during completion of the well. In order to form a remedial annulus seal in a well after being completed, it is most common in the art to carry out so-called squeeze cementing where a suitable cement slurry is forced into a well annulus via openings in a pipe structure. Alternatively, a suitable gel may be forced into the well annulus. The openings in the pipe structure may, for example, be perforations or slots in a casing, or filter openings in a sand screen, etc. In order to transport cement slurry or gel onto a desirable location in the well, a pipe string is typically used, for example coiled tubing or drill pipes. In this context, also at least one so-called straddle packer is typically used to define at least one injection zone in the well for injection of said cement slurry or gel.

The use and/or efficiency of these known techniques involve(s), among other things, increased operational complexity and risk, as well as further completion costs for a well. The zone isolation techniques also lack the operational flexibility desirable during a well's operating phase after completion.

With respect to the present invention, however, the closest prior art appears to be described in WO 2006/098634 (Triangle Technology AS). This publication describes a method and device for in situ formation of a seal in an annulus in a well. According to WO 2006/098634, the device comprises, among other things, a perforation device for allowing a hole to be made through a pipe wall, and also a packer injection module for allowing a liquid packer material to be forced into said annulus in the well. Thereafter the liquid packer material will enter into solid state and form a seal in the annulus. For this purpose the packer injection module comprises at least a packer chamber containing a solid-state, fusible packer material; a heating device to allow the solid-state packer material to be melted; a driving device with an associated propulsion device for allowing molten, liquid packer material to be driven out of the packer chamber; and a connection means for allowing the packer chamber to be connected in a flow-communicating manner to said hole through the pipe wall and then to conduct liquid packer material further into the annulus.

One disadvantage of the invention according to WO 2006/098634 is that it is confined to the use of a solid-state, fusible packer material for making a remedial seal in an annulus in a well. It does not describe a technical solution suitable for introduction of a more general treatment means into said annulus, wherein this treatment means may be a suitable sealing mass, but wherein the treatment means just as well may be a well stimulation means or other liquid material.

In one embodiment disclosed in WO 2006/098634, also the packer injection module is connected in a flow-communicating manner to a flow-through connection module comprising said perforation device for making a hole through the pipe wall. A connection module to be used both for perforation of the pipe wall and for subsequent hole connection involves both a technical and operational complexity which may prove difficult during use as, among other things, a source of operational problems and potential shutdown.

Due to the above-mentioned problems and disadvantages associated with prior art in this field, a great interest therefore exists in the industry for technical solutions rendering in situ introduction of a suitable treatment means into an annulus in a well simpler and less costly, especially during the operating phase after completion.

OBJECTS OF THE INVENTION

The primary object of this invention is to avoid or reduce at least one of the above-mentioned problems and disadvantages of the prior art.

More specifically, the object of the invention is to provide a technical solution for in situ introduction of a treatment means into an annulus located outside a pipe structure in a well.

The objects are achieved by virtue of features disclosed in the following description and in the subsequent claims.

GENERAL DESCRIPTION OF HOW TO ACHIEVE THE OBJECTS

According to a first aspect of the present invention, a well tool for in situ introduction of a treatment means into a region of an annulus located outside a pipe structure in a well is provided. For example, the pipe structure may be comprised of a well pipe or a sand screen or similar in the well. According to this first aspect, the well tool comprises:

- at least one anchoring body for anchoring against an inside of the pipe structure;
- at least one perforation device for forming at least one hole through the wall of the pipe structure;
- at least one storage chamber for storing the treatment means;
- at least one driving means for forcing liquid treatment means out of the storage chamber;
- at least one flow-through connection device connected in a flow-communicating manner to the storage chamber and structured in a manner allowing it to be connected in a flow-communicating manner to said hole through the wall of the pipe structure for injection of liquid treatment means into said region of the annulus;
- wherein the well tool is structured for receiving energy and control signals for operation of the well tool.

The distinctive characteristic of the well tool is that said anchoring body is disposed in an anchoring module;

- wherein at least said storage chamber, driving means and connection device are operatively connected to an injection module;
- wherein the injection module is structured in a manner allowing it to be moved axially relative to the anchoring module, thereby allowing the connection device to be moved to a position in vicinity of said hole after the forming thereof; and
- wherein the well tool comprises at least one alignment means for alignment of the connection device vis-à-vis the hole through the wall of the pipe structure for connection to the hole and subsequent injection of liquid treatment means into said region of the annulus.

References to "axial" in this description refer to the direction of the longitudinal centre line of the well tool.

Said distinctive characteristic of the present well tool differs from all of the above-mentioned, known well tool for injection of a mass into an annulus in a well.

By means of the present well tool and method, in situ introduction of a suitable treatment means into a region of said annulus may be carried out, wherein the treatment means is conveyed into the well together with the well tool. This brings about obvious technical, operational and cost-related advantages with respect to said prior art.

In this context, the treatment means may, for example, be comprised of a sealing mass, including fusible plastics, thermosetting plastics, epoxy, metal, sulphur or other material of a suitable type. The treatment means may also be comprised of a well stimulation means, including stimulation chemicals, scale inhibitors, gel materials, etc. Moreover, any treatment means suitable for the particular task in the annulus of the well may be used. The essential thing of the present invention is not which treatment means is used in the annulus, but the manner in which the treatment means is introduced at its location within the annulus.

Further, the well tool may be structured for conveyance into the pipe structure by means of a connection line. Thus, the connection line may comprise a pipe string, for example a pipe string composed of coiled tubing. The connection line may also comprise a flexible cable, for example an electric cable. By so doing, the well tool may be conveyed into the well by means of conventional conveyance means.

For use particularly in highly deviated wells and horizontal wells, the well tool may also be structured for connection to a well tractor for conveyance into the pipe via the connection line. Such a well tractor is usually provided with wheels, rollers or similar movement bodies for contact with, and movement within, the surrounding well pipe. In this context, also the lower and free end of the well tool may be provided with suitable movement bodies for support and movement within the well pipe. Alternatively, the lower and free end of the well tool may be operatively connected to a movable guide section, which forms a protective and stabilizing front end of an assembly of the well tool and the guide section. Similar to the well tractor, such a guide section may also be provided with suitable movement bodies for support and movement within the well pipe.

Yet further, the well tool may be structured for operation within the pipe structure without having to use a connection line between the well tool and surface. Such an embodiment requires that the well tool is structured more or less in an autonomous manner, wherein the control signals are transmitted wirelessly, and wherein the well tool is self-sufficient with respect to energy. Such a well tool may also comprise suitable movement bodies for contact with, and movement within, the surrounding well pipe.

Alternatively, such a well tool may be connected to a remote-controlled well tractor structured for wireless operation. For example, the well tool and a potential well tractor may be conveyed into the pipe structure, or be pulled out therefrom, by means of a slick steel line or another connection line of the above-mentioned types.

For conveyance into the pipe structure, such a well tool and a potential well tractor may also be dropped down into the pipe structure in a controlled manner. In order to avoid damage to the well tool and a potential well tractor whilst descending down through the pipe structure, the well tool/well tractor may be connected to a piece of speed-braking equipment or similar. Then, and via wireless remote control, said movement bodies may be employed to move the well tool and a potential well tractor onwards to the desired location in the pipe structure.

Hereinafter, constructive features of the present well tool will be discussed in further detail.

According to a first embodiment of the well tool, also said perforation device may be operatively connected to the injection module;

wherein the injection module is connected in an axially movable manner to the anchoring module, whereby the injection module is movable relative to the anchoring module; and wherein the injection module is non-rotatably connected to the anchoring module. This non-rotatable connection constitutes an alignment means for axial alignment of the connection device relative to said hole through the wall of the pipe structure.

In this context, said perforation device may be disposed in a perforation module operatively connected to the injection module.

The well tool according to this first embodiment constitutes a one-trip well tool, i.e. a well tool structured in a manner allowing it to carry out all necessary downhole operations by means of one trip into the well.

In this one-trip well tool, the injection module may be movably connected to a rotation-preventing guide means associated with the anchoring module.

Thus, this guide means may comprise at least one of the following guide elements: a guide pin; a guide track; a guide shoe; a guide bar; and a guide rail.

Such a guide means will prevent rotation of the injection module whilst being moved axially relative to the anchoring module, which remedies the axial alignment of the connection device relative to said hole through the wall of the pipe structure.

In this one-trip well tool, the injection module and the anchoring module may be connected in an axially movable manner via at least one connection body.

As an example, this connection body may be comprised of an axially movable piston rod;

wherein one end of the piston rod is operatively connected to a piston in a cylinder disposed in the anchoring module, whereas the other end of the piston rod extends outwards from the cylinder and is operatively connected to the injection module. Thereby, the injection module is axially movable upon movement of the piston.

As another example, this connection body may be comprised of an axially movable shaft;

wherein one end of the shaft, via a threaded connection, is operatively connected to a rotatable force transmission body disposed in the anchoring module, whereas the other end of the shaft is operatively connected to the injection module. By so doing, the injection module is axially movable upon rotation of the force transmission body. This force transmission body may be comprised of a sleeve-shaped body provided with threads. Moreover, the force transmission body may be connected to a hydraulic motor, electric motor or similar motive power source for rotation of the force transmission body. Upon rotation of the force transmission body, the shaft will move axially, whereby also the injection module will move in an axial direction.

Yet further, said axially movable connection body may be non-rotatably connected to the anchoring module. This non-rotatable connection body constitutes an alignment means for axial alignment of the connection device relative to said hole through the wall of the pipe structure.

As an example of the latter, the well tool may therefore comprise a rotation-preventing connection between the axially movable connection body and the anchoring module. Further, this rotation-preventing connection may comprise a tongue-and-groove type of connection, for example a connection comprised of spline connection.

As another example of the latter, the axially movable connection body may have a non-circular cross-sectional shape, whereas the anchoring module comprises an axial opening having a complementary, non-circular cross-sectional shape relative to that of the connection body. Also this will constitute a rotation-preventing connection.

According to a second embodiment of the present well tool, said perforation device may be operatively connected to a perforation module;

wherein both the anchoring module, the perforation module and the injection module are structured as separate modules; and wherein both the perforation module and the injection module are structured in a manner allowing them to be releasably connected to the anchoring module. Thereby, both the injection module and the anchoring module are movable relative to the perforation module.

The well tool according to this second embodiment constitutes a two-trip well tool, i.e. a well tool structured in a manner allowing it to carry out all necessary downhole operations by means of two or more trips into the well.

This two-trip well tool may comprise an orientation instrument including a first orientation means and a second orientation means;

wherein the second orientation means is structured in a manner allowing it to be releasably connected to, and positioned relative to, the first orientation means;

wherein the anchoring module is provided with the first orientation means; and wherein the perforation module and the injection module are provided each with a second orientation means. This orientation instrument constitutes an alignment means for alignment of the connection device vis-à-vis said hole through the wall of the pipe structure.

Accordingly, this orientation instrument may comprise at least one of the following orientation elements:

an orientation track;
an orientation pin;
an orientation key;
an orientation slot;
an orientation helix; and
an orientation cone.

Furthermore, the perforation device of the present well tool may be comprised of one of the following perforation means for being able to make said hole:

a drilling device;
a punching implement;
a perforation gun comprising at least one explosive charge;
a waterjet implement; and
a corrosive implement comprising a corrosive agent.

The present well tool may also comprise:

at least one power unit for delivering motive power to operative components in the well tool; and
at least one control unit for signal processing and operation control of the well tool.

In this context, said connection line may be structured in a manner allowing it to transmit energy and control signals to the power unit and control unit for operation of the well tool.

As an alternative, the well tool may also comprise:

a signal transmission unit structured for wireless reception of control signals to said control unit; and
at least one energy source for delivering energy to said power unit, control unit and signal transmission unit.

When using said more or less autonomous well tool, which is operated without a connection line, the latter embodiment must be used.

The treatment means to be introduced into a region of said annulus, may also be located in a replaceable receptacle placed in said storage chamber in the injection module of the well tool.

Hereinafter, reference will be made to a second aspect of the present invention. According to this second aspect, a method for in situ introduction of a treatment means into a region of an annulus located outside a pipe structure in a well is provided.

The distinctive characteristic of the method is that it comprises the following steps:

(A) using a well tool according to the first aspect of the present invention;
(B) conveying at least said anchoring module and said perforation device into the pipe structure to a location vis-à-vis said region of the annulus;
(C) anchoring the at least one anchoring body of the anchoring module against the inside of the pipe structure;
(D) by means of said perforation device, making at least one hole through the wall of the pipe structure;
(E) moving the perforation device away from said hole through the wall of the pipe structure;
(F) moving said connection device, which is operatively connected to the injection module, to a position in vicinity of said hole through the wall of the pipe structure;
(G) by means of the at least one alignment means of the well tool, aligning the connection device vis-à-vis said hole through the wall of the pipe structure;
(H) connecting the connection device in a flow-communicating manner to said hole through the wall of the pipe structure;
(I) by means of said driving means operatively connected to the injection module, forcing liquid treatment means out of the storage chamber for injection of the treatment means into said region of the annulus via the connection device and said hole through the wall of the pipe structure, thereby placing the treatment means into the annulus; and
(J) disconnecting the well tool from the pipe structure and pulling the well tool out of the well.

The method according to steps (A)-(J) applies both to said one-trip and two-trip well tools according to the first aspect of the present invention.

In step (B), the method may comprise the step of conveying the well tool into the pipe structure by means of a connection line of the above-mentioned types.

According to a first embodiment, the method may also comprise the following steps:

before step (B), operatively connecting said perforation device to the injection module and connecting the injection module in an axially movable and non-rotatable manner to the anchoring module so as to form an assembly thereof;
in step (B), conveying the assembly of the injection module and the anchoring module into the pipe structure to said location vis-à-vis said region of the annulus;
in step (D), and by means of the perforation device of the injection module, making said hole through the wall of the pipe structure; and
in step (E) and (F), moving the injection module axially relative to the anchoring module, thereby simultaneously moving the connection device of the injection module to a position in vicinity of said hole. In this context, the non-rotatable connection constitutes an alignment means for axial alignment of the connection device relative to said hole.

This first embodiment of the method involves use of said one-trip well tool.

According to a second embodiment, the method may also comprise the following steps:

before step (B), operatively connecting said perforation device to a perforation module; and structuring both the anchoring module, the perforation module and the injection module as separate modules; and structuring both the perforation module so and the injection module in a manner allowing them to be releasably connected to the anchoring module;
in step (B), conveying a releasable assembly of the anchoring module and the perforation module into the pipe structure to said location vis-à-vis said region of the annulus;
in step (D), and by means of the perforation device of the perforation module, making said hole through the wall of the pipe structure;
in step (E), disconnecting the perforation module from the set anchoring module and pulling the perforation module out of the well, thereby moving said perforation device away from said hole through the wall of the pipe structure; and
after step (E), conveying the injection module into the pipe structure and releasably connecting the injection module to the set anchoring module, thereby simultaneously achieving steps (F) and (G) of the method.

This second embodiment of the method involves use of said two-trip well tool.

In the present method, the treatment means may, for example, be comprised of a sealing mass or a well stimulation means, as mentioned above in context of describing the present well tool.

Further, the present method may be used in various contexts and for various purposes.

Thus, in step (I) of the method, the treatment means may be injected into a region of an annulus located outside a sand screen associated with the pipe structure. Alternatively, the treatment means may be injected into a gravel pack disposed in the annulus. As a further alternative, the treatment means may be injected into a region of an annulus defined by said pipe structure and an external pipe.

Hereinafter, reference will be made to two non-limiting, exemplary embodiments of the present invention.

SHORT DESCRIPTION OF THE FIGURES OF THE EXEMPLARY EMBODIMENTS

FIG. 1 shows main constituents of this one-trip well tool;

FIGS. 2-4 show, in partial section and in larger scale, details of an anchoring module of the well tool according to FIG. 1, FIGS. 2-4 also showing different positions of operation of the anchoring module;

FIGS. 5-7 show, in partial section and in larger scale, other modules of the well tool according to FIG. 1;

FIGS. 8 and 9 show, in partial section and in larger scale, details of an injection module of the well tool according to FIG. 1, FIGS. 8 and 9 showing the injection module when in an inactive and active position, respectively;

FIG. 10 shows, in partial section and in larger scale, details of a perforation module of the well tool according to FIG. 1; and FIGS. 11-18 show various steps of a first embodiment of the method according to the invention when used together with said one-trip well tool according to FIGS. 1-10;

FIGS. 19-21 show main constituents of this two-trip well tool;

FIG. 22 shows, in partial section and in larger scale, details of an injection module of the well tool according to FIGS. 19-21, FIG. 22 showing the injection module when in an active position;

Figure 22:
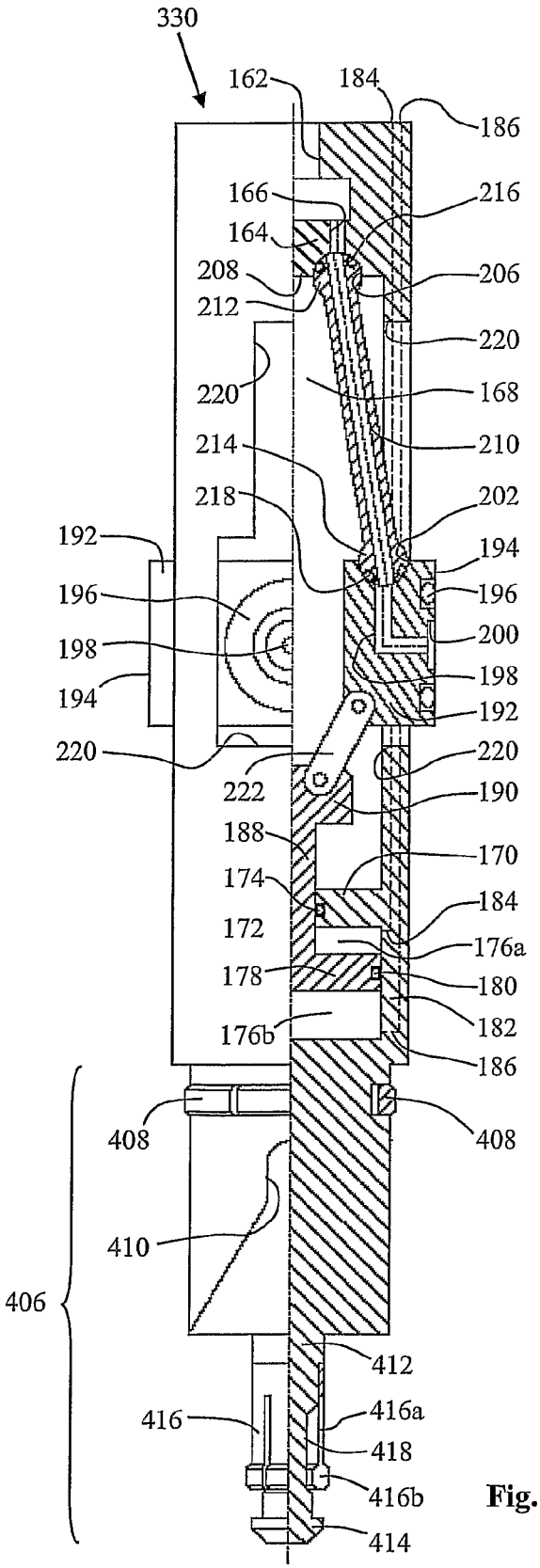
Figure 23:
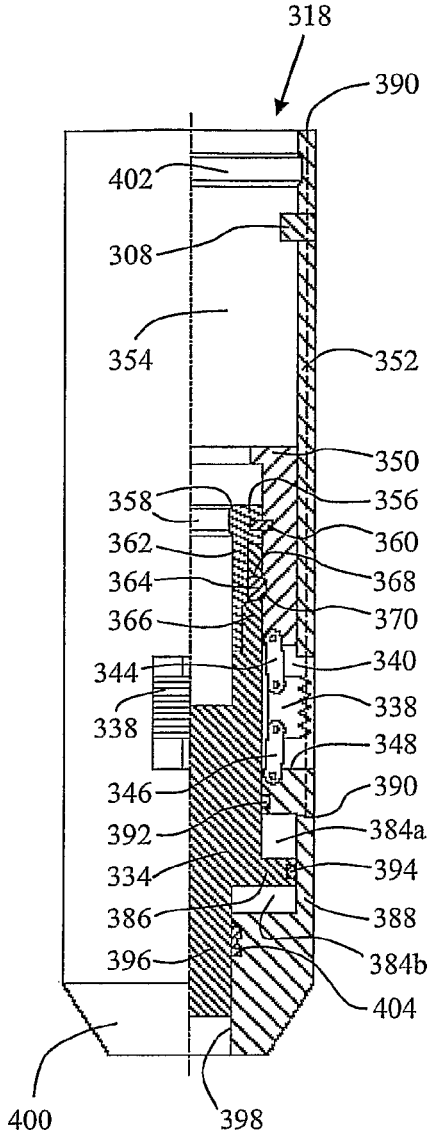
Figure 24:
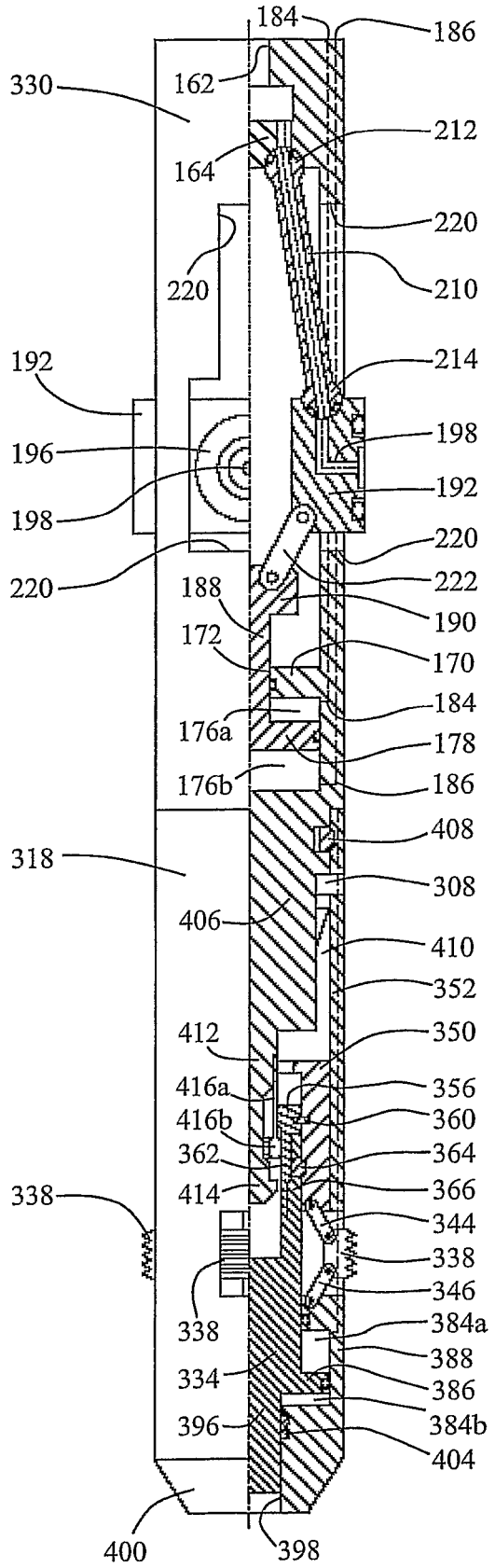
Figure 31:
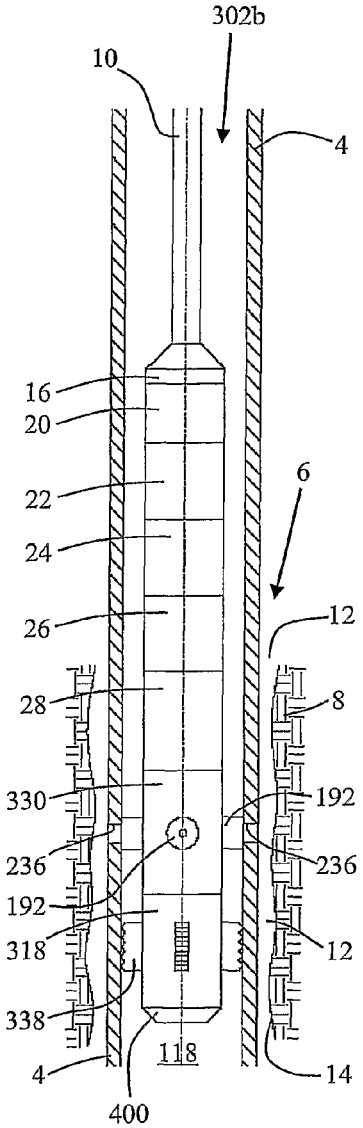
Figure 32:
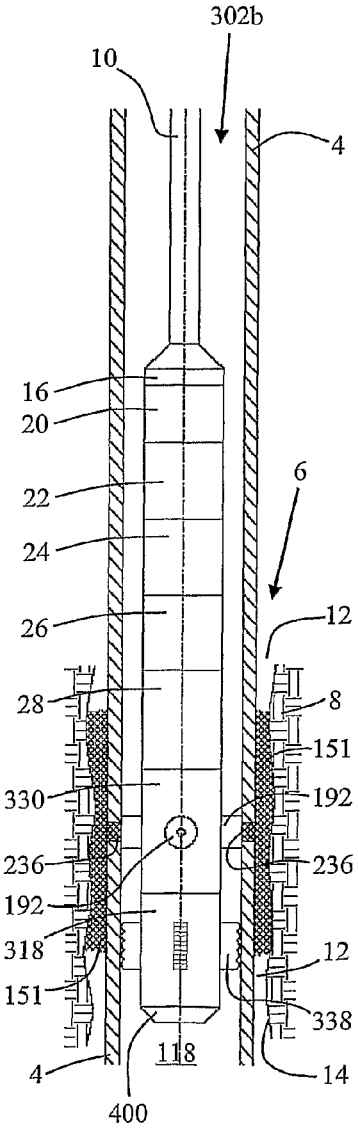
Figure 33:
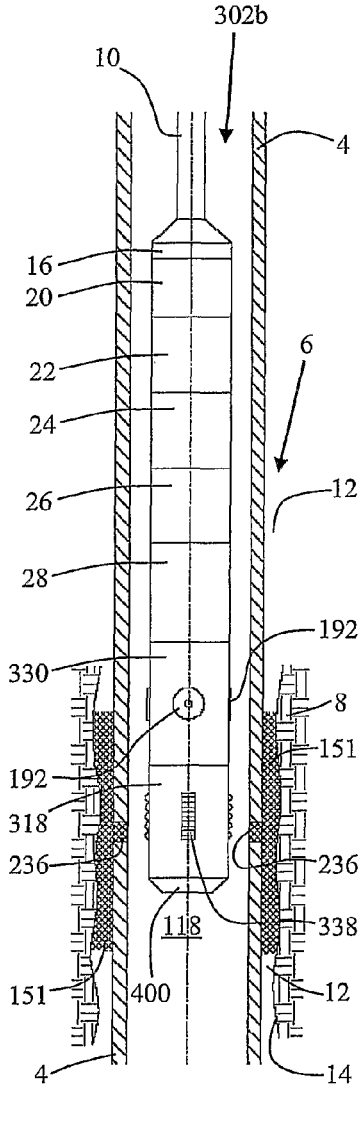

FIG. 23 shows, in partial section and in larger scale, details of an anchoring module of the well tool according to FIGS. 19-21, FIG. 23 showing the anchoring module when in an inactive position; and FIG. 24 shows an assembly of the injection module and the anchoring module according to FIGS. 22 and 23, respectively, both the injection module and the anchoring module being shown in their active positions, as indicated later in FIGS. 31 and 32.

Figure 19:
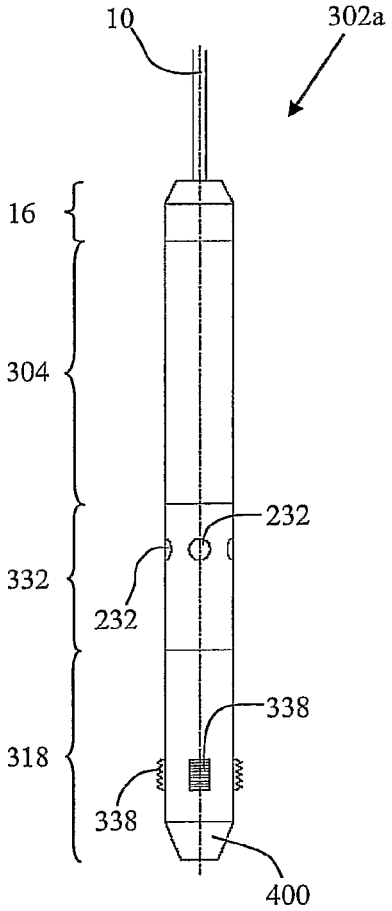
FIGS. 19-33 show an embodiment of a two-trip well tool according to the invention, where.
Figure 20:
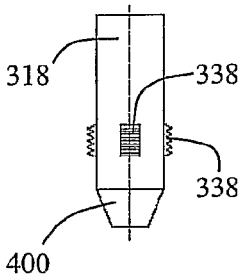
Figure 21:
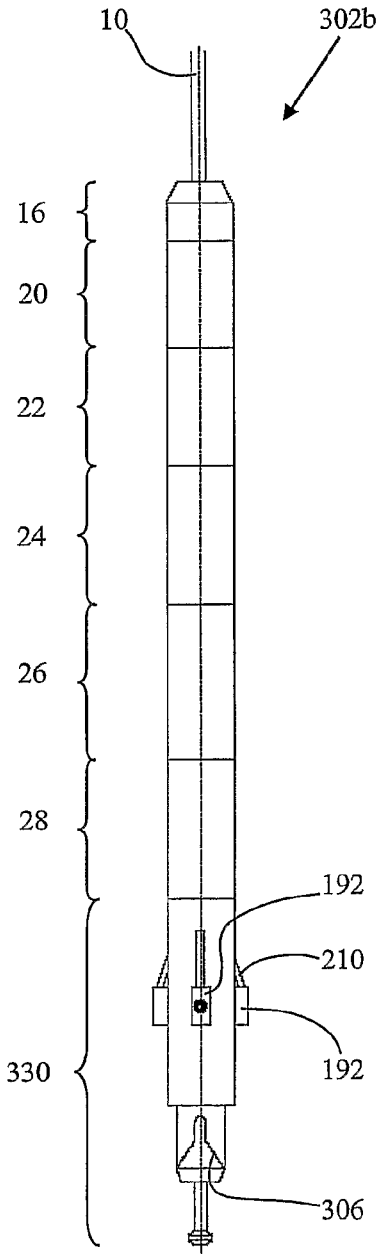

FIGS. 25-33 show various steps of a second embodiment of the method according to the invention when used together with said two-trip well tool according to FIGS. 19-21.

In order to facilitate the understanding of the invention, the figures are drawn in a somewhat simplified manner and show only the most essential components and elements of the present well tool. The shapes, relative dimensions and mutual positions of the components and elements may also be somewhat distorted. Moreover, all references to "upper" and "lower" in context of a component or element refer to a location being closer or further away, respectively, from the surface of the well.

PARTICULAR DESCRIPTION OF THE EXEMPLARY EMBODIMENTS

Exemplary Embodiment No. 1

Figure 1:
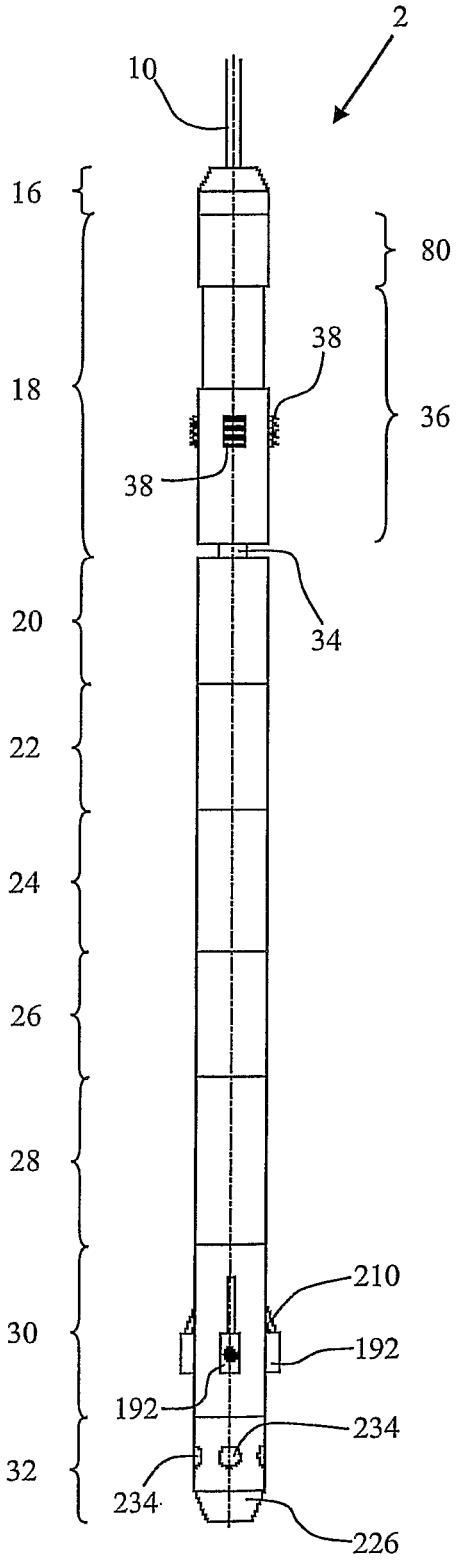
FIGS. 1-18 show an embodiment of a one-trip well tool according to the invention, where.

FIG. 1 shows main constituents of a one-trip well tool 2 according to the invention. FIGS. 2-10 show details of some of the main constituents, whereas the main constituents are shown interconnected in FIGS. 11-18. FIGS. 11-18 show various steps associated with the use of the well tool 2 in a casing 4 in a well 6 extending down to a formation 8 in the subsurface. For conveyance within the well 6, the well tool 2 is connected to a connection line in the form of an electric cable 10 extending down from surface. Additionally, the cable 10 is structured in a manner allowing it to transmit electric power, control signals and similar to/from the well tool 2 during operation thereof. In this exemplary embodiment, the well tool 2 is to be used to force a liquid sealing mass into a region of an annulus 12 between the casing 4 and a surrounding borehole 14

In another exemplary embodiment (not shown), the well tool 2 may just as well be used to force a treatment means, for example a liquid sealing mass, into a region of an annulus located between two casings of different diameters, or similar pipe structures.

As viewed in sequence from above and downwards, said main constituents (cf. FIG. 1) comprise: a connector 16; an anchoring module 18; a valve module 20; a control module 22; a hydraulic oil module 24; a hydraulic pump module 26; a storage module 28; an injection module 30; and a perforation module 32. Hereinafter, the construction and/or function of these constituents will be explained in further detail.

The connector 16 interconnects the electric cable 10 and the well tool 2 when being used in the well 6, the connector 16 connecting the cable 10 to an upper end of the anchoring module 18.

This anchoring module 18 (cf. FIGS. 2-4) has two functions. The first function is to anchor an upper portion of the well tool 2 to the inner pipe wall of the casing 4. The second function is to move a connection body, which in this embodiment is comprised of an axially movable and massive piston rod 34, outwards from a lower end of the anchoring module 18.

Figure 2:
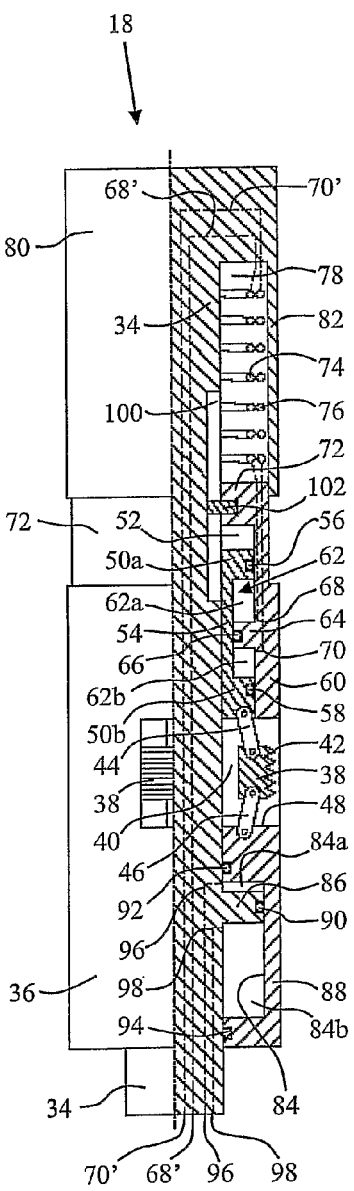
Figure 3:
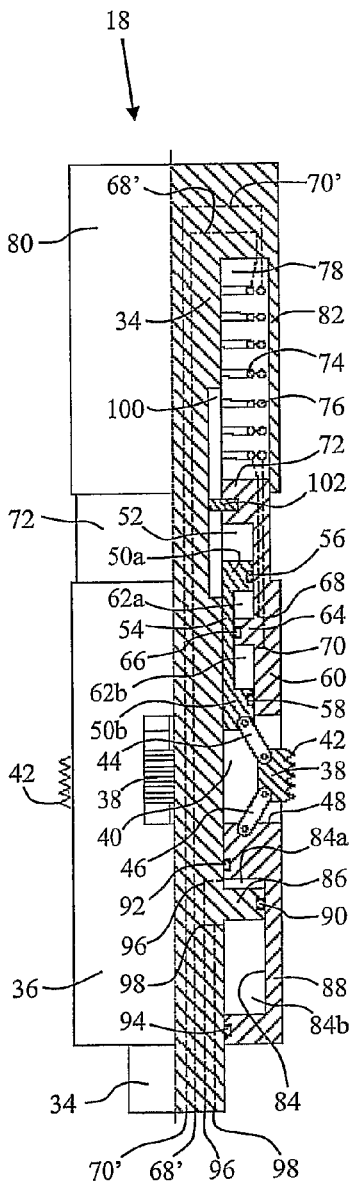
Figure 4:
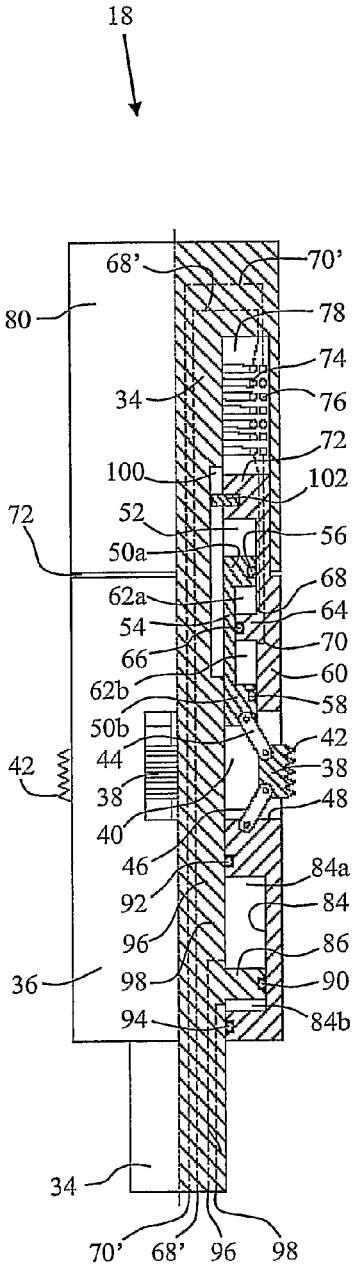
Figure 5:
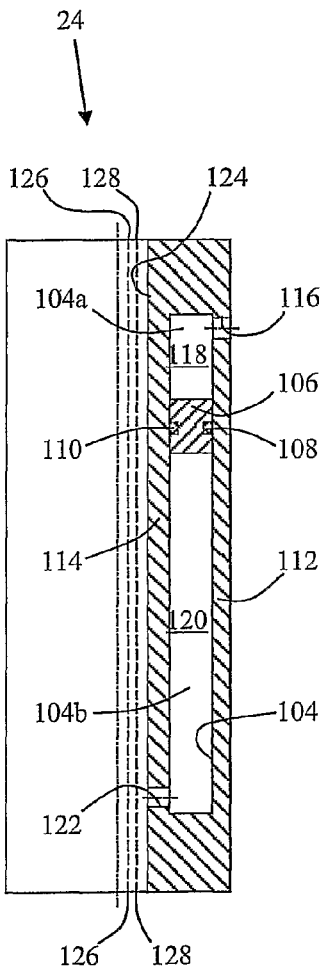

In order for the anchoring module 18 to carry out its first function, a first part 36 thereof is provided with four radially movable gripping elements 38, only three gripping elements 38 of which are shown in FIGS. 2-4. Each gripping element 38 may move radially outwards from a recessed cavity 40 disposed in the first part 36 of the module 18. Additionally, each gripping element 38 is provided with external gripping teeth 42 as well as two hinge joints 44, 46 disposed pivotally at an upper and lower axial portion, respectively, of the gripping element 38. The lower hinge joint 46 is pivotally connected to a fixed lower wall 48 of the recessed cavity 40, whereby the hinge joint 46 is fixed to the first part 36 of the module 18. The upper hinge joint 44, however, is pivotally connected to a ring-shaped double piston **50*a*, 50*b*, which may move axially within a ring-shaped first piston cylinder 52 formed in the first part 36 of the module 18. An upper piston 50*a* and a lower piston 50*b* of the double piston are connected via a pipe-shaped piston rod 54 enclosing said massive piston rod 34 extending outwards from the lower end of the anchoring module 18. In order to prevent fluid leakage, the periphery of each piston 50*a*, 50*b* is provided with a respective ring gasket 56, 58, which is in sealing contact with an outer sleeve portion 60 defining the first piston cylinder 52**.

Further, the pistons **50*a*, 50*b*, the piston rod 54 and the first piston cylinder 52 define a ring-shaped cylinder chamber 62*a*, 62*b*. A ring-shaped fixed piston 64 is fixed to the inside of the outer sleeve portion 60 and extends radially inwards into the ring-shaped cylinder chamber 62*a*, 62*b*, and inwards onto the piston rod 54 of the double piston 50*a*, 50*b*. At its inner periphery, the fixed piston 64 is provided with a gasket ring 66, which is in sealing contact with the piston rod 54. Thereby, the fixed piston 64 separates the ring-shaped cylinder chamber of the double piston 50***a*, 50*b* into an upper cylinder chamber 62*a* and a lower cylinder chamber 62*b*.

Two hydraulic conduits 68, 70 (shown schematically with dashed lines in FIGS. 2-4) are formed in an outer sleeve portion 72 of the first part 36 of the module 18 and are directed onwards to the upper and lower cylinder chamber 62*a*, 62*b*, respectively, on either side of the fixed piston 64. Each hydraulic conduit 68, 70, at the opposite end thereof, is connected to a respective coiled hydraulic pipe 74, 76 disposed within a cavity 78 at a second part 80 of the anchoring module 18. In FIGS. 2 and 3, the hydraulic pipes 74, 76 are shown in an axially relaxed position, whereas FIG. 4 shows the hydraulic pipes 74, 76 in an axially compressed position. At its opposite end, each hydraulic pipe 74, 76 is connected to a respective hydraulic conduit 68', 70' (shown schematically with dashed lines in FIGS. 2-4) directed onwards through said massive piston rod 34 extending outwards from the lower end of the anchoring module 18. The second part 80 of the module 18 is also provided with a sleeve-shaped, external cover 82, which protects the cavity 78 and its coiled hydraulic pipes 74, 76. The cover 82 may be moved axially on the outside and overlaps a part of said outer sleeve portion 72 of the first part 36 of the module 18.

FIG. 2 shows the double piston 50*a*, 50*b* when in an inactive position within which the gripping elements 38 are retracted into the recessed cavity 40 in the first part 36 of the module 18. FIGS. 3 and 4, however, show the double piston 50*a*, 50*b* when in an active position within which the gripping elements 38 are extended radially outwards from the recessed cavity 40. The latter is achieved by supplying pressurized hydraulic oil to said lower cylinder chamber 62*b* via the hydraulic conduits 70, 70' and the coiled hydraulic pipe 76. Thereby, the double piston drives the ring-shaped lower piston 50*b* in the axial direction towards the recessed cavity 40 and its fixed lower wall 48, whereby the gripping elements 38 are forced radially outwards via said two hinge joints 44, 46. A subsequent retraction of the gripping elements 38 into the cavity 40 is carried out by supplying pressurized hydraulic oil to said upper cylinder chamber 62*a* via the hydraulic conduits 68, 68' and the coiled hydraulic pipes 74. Thereby, the double piston drives the ring-shaped upper piston 50*a* in the axial direction away from the recessed cavity 40 and its fixed lower wall 48.

In order to carry out its second function, the first part 36 of the anchoring module 18 is also provided with a ring-shaped second piston cylinder 84*a*, 84*b* formed at the lower end of the module 18. A ring-shaped piston 86 is fixed to the outside of said massive piston rod 34. The ring-shaped piston 86 extends outwards into the second piston cylinder 84*a*, 84*b* and further outwards onto an outer sleeve portion 88 of the cylinder 84*a*, 84*b*. At its periphery, the piston 86 is provided with a ring gasket 90, which is in sealing contact with the mantle wall 88. Thereby, the piston 86 separates the second piston cylinder into an upper cylinder chamber 84*a* and a lower cylinder chamber 84*b*. At the upper and lower end of the piston cylinder 84*a*, 84*b*, the first part 36 of the module 18 is also provided with respective ring gaskets 92, 94, which are in sealing contact with the piston rod 34.

Two further hydraulic conduits 96, 98 (shown schematically with dashed lines in FIGS. 2-4) are formed in the piston rod 34 and are directed onwards to the upper and lower cylinder chamber 84*a*, 84*b*, respectively, on either side of the ring-shaped piston 86. At the upper portion of the first part 36 of the module 18, the piston rod 34 is also provided with an axially directed guide track 100 recessed into the external surface of the piston rod. A radially directed guide pin 102 is fixed to the external sleeve portion 72 of the first part 36 of the anchoring module 18 and extends inwards into the guide track 100 in the piston rod 34 (cf. FIGS. 2 and 3). The guide pin 102 constitutes a rotation-preventing guide means associated with the anchoring module 18, whereby the injection module 30 is non-rotatably connected to the anchoring module 18.

Upon supplying pressurized hydraulic oil to said upper cylinder chamber 84*a* via the hydraulic conduit 96, the ring-shaped piston 86 may be driven in the axial direction downwards and towards the lower end of the anchoring module 18, as shown in FIG. 4. During this axial movement, the coiled hydraulic pipes 74, 76 are also forced together axially, which is also shown in FIG. 4. This axial movement also provides for simultaneous axial movement of the associated, massive piston rod 34. Insofar as the opposite axial end of the piston rod 34 is connected directly to the valve module 20, which in sequence is connected to the other modules 22, 24, 26, 28, 30, 32 of the well tool 2, this axial movement will also cause simultaneous axial movement of all of these modules 20, 22, 24, 26, 28, 30, 32.

Hereinafter, the construction and/or function of the valve module 20, the control module 22, the hydraulic oil module 24, the hydraulic pump module 26, the storage module 28, the injection module 30 and the perforation module 32 will be discussed in further detail. However, the valve module 20 and the control module 22, which are shown in FIGS. 1 and 11-18, will not be described in the same detail as for the anchoring module 18. The reason for this is that the modules 20, 22 comprise components known per se, and modes of operation thereof, so as to be considered to represent prior art to a person skilled in the art.

When the well tool 2 is in operation in the well 6, electric energy and control signals are transmitted from surface and down to the control module 22 via the electric cable 10, the connector 16, the anchoring module 18 and the valve module 20. The control module 22 may comprise electronic components, including suitable processors and software, as well as sensors, signal transmitters, electric wires, batteries, etc. to the degree considered necessary for providing a functional operation of various components in the well tool 2. Energy and control signals, possibly also suitable fluids, may be transmitted via lines, pipes, conduits and/or hoses, as well as couplings, valves and similar (not shown in the figures) which are suitably disposed in or on the connector 16 and the various modules 18, 20, 22, 24, 26, 28, 30, 32 of the well tool 2.

The valve module 20 comprises a group of suitable valves (not shown) for supply and suitable distribution of fluids, such as hydraulic oil in this example, to various movable components in the well tool 2. The opening and closing of the valves is controlled by control signals from the control module 22. Motive power for the opening and closing of the valves may come from the control module 22 and/or be provided by independent power sources and/or devices in the valve module 20. Thus, the valve module 20 and the control module 22 may provide for a suitable supply and control of hydraulic oil to/from said ring-shaped double piston 50*a*, 50*b* and ring-shaped piston 86. By so doing, the gripping elements 38 and the massive piston rod 34, respectively, may be moved in a suitable manner relative to the anchoring module 18, as shown in FIGS. 2-4.

The hydraulic oil module 24 (cf. FIG. 5) comprises a reservoir for hydraulic oil to be used for movement of movable components in various modules of the well tool 2, for example for movement of said ring-shaped double piston 50*a*, 50*b* and ring-shaped piston 86 in the anchoring module 18. The latter components are connected in a flow-communicating manner to the hydraulic oil module 24 via said hydraulic conduits 68, 70, 68', 70', 96, 98 and coiled hydraulic pipes 74, 76 in the anchoring module 18, and also via corresponding hydraulic conduits in the valve module 20 and control module 22. Corresponding flow connections are arranged between the hydraulic oil module 24 and movable components in the hydraulic pump module 26, in the storage module 28 and in the injection module 30.

In this exemplary embodiment, said reservoir for hydraulic oil is comprised of a ring-shaped hydraulic oil cylinder 104*a*, 104*b*. This cylinder 104*a*, 104*b* is provided with a ring-shaped and axially movable free-float piston 106 having an external ring gasket 108 and an internal ring gasket 110 for sealing contact with an outer sleeve 112 and an inner sleeve 114, respectively, the sleeves of which collectively define the ring-shaped hydraulic oil cylinder 104*a*, 104*b*. The free-flow piston 106 separates the hydraulic oil cylinder into an upper cylinder chamber 104*a* and a lower cylinder chamber 104*b*. At its upper end, the outer sleeve 112 is provided with a radial vent bore 116, which connects the upper cylinder chamber 104*a* in a flow-communicating manner with a well liquid 118 (and the pressure in the well liquid 118) in the casing 4, whereby the upper cylinder chamber 104*a* is filled with well liquid 118. The lower cylinder chamber 104*b*, however, is filled with hydraulic oil 120. At its lower end, the inner sleeve 114 is provided with a radial bore 122, which connects the lower cylinder chamber 104*b* in a flow-communicating manner to several hydraulic pipes carried along an axial bore 124 through the hydraulic oil module 24. Even though the axial bore 124 comprises several such hydraulic pipes, only two hydraulic pipes 126, 128 are shown schematically with dashed lines in FIG. 5. The hydraulic pipes 126, 128 are connected in a flow-communicating manner to the valve module 20 and the control module 22 for suitable control and conveyance of hydraulic oil 120 onto movable components in the injection module 30. Hereinafter, the latter will be discussed in detail, and particularly in context of the description of the injection module 30. For conveyance of hydraulic oil 120 to the movable components in the injection module 30, the hydraulic pipes 126, 128 are also connected in a flow-communicating manner to corresponding flow connections in the hydraulic pump module 26, the storage module 28 and in constituents of the injection module 30, which are shown schematically with dashed lines in FIGS. 6-9.

Figure 6:
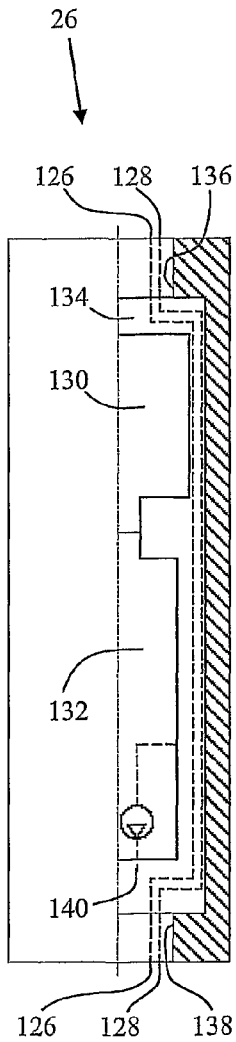
Figure 7:
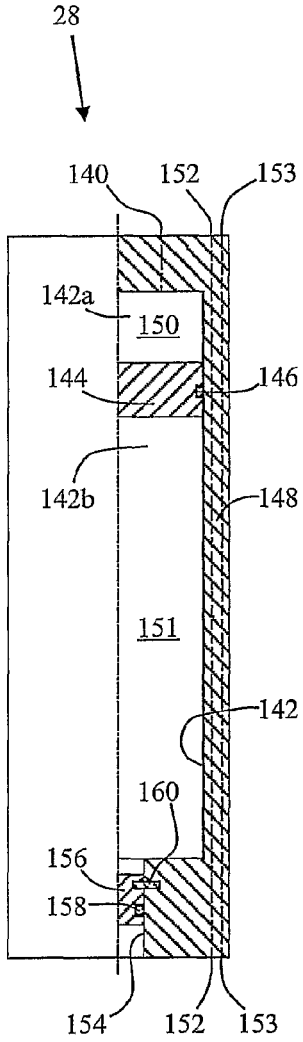

The hydraulic pump module 26 (cf. FIG. 6) comprises an electric motor 130 and a hydraulic pump device 132, which are operatively connected to the storage module 28. The pump device 132 and the motor 130, both of which are shown schematically in FIG. 6, are placed within a cylinder-shaped cavity 134 in the pump module 26. In order to convey hydraulic oil 120 onto the injection module 30, an axial bore 136, 138 is directed outwards from an upper and lower end, respectively, of the cavity 134 for conveyance of various hydraulic pipes, including said two hydraulic pipes 126, 128 from the hydraulic oil module 24. The upper axial bore 136 and the cavity 134 also accommodate electric connection wires (not shown in FIG. 6) for transmission of electric motive power and control signals from the control module 22 to the motor 130. The pump device 132, which uses the joint hydraulic oil of the well tool 2, is connected to a hydraulic pipe 140 (shown schematically with a dashed line) directed outwards from the cavity 134 and the lower axial bore 138 for conveyance of the hydraulic oil of the pump device 132 onto the separate storage module 28 (cf. FIG. 7).

The storage module 28, which is operatively connected to the injection module 30, comprises a cylinder-shaped storage chamber 142*a*, 142*b* provided with an axially movable free-float piston 144 having an external ring gasket 146 for sealing contact with an enclosing sleeve 148. The free-float piston 144 separates the storage chamber into an upper chamber 142*a* and a lower chamber 142*b*. The upper chamber 142*a* is connected in a flow-communicating manner to said hydraulic pipe 140 from the pump device 132, whereby the chamber 142*a* is filled with hydraulic oil 150 from the pump device 132. The lower chamber 142*b*, however, is filled with a treatment means, which in this exemplary embodiment is comprised of a liquid sealing mass 151. The enclosing sleeve 148 is also provided with axially directed hydraulic conduits 152, 153, which are connected in a flow-communicating manner to said corresponding hydraulic pipes 126, 128 through the pump module 26 and the storage module 28.

An axial bore 154 is directed further outwards from the lower end of the storage chamber 142*a*, 142*b*. A cylindrical plug 156 having a peripheral ring gasket 158 is attached within the bore 154 by means of a radial shear pin 160, which connects the plug 156 to the lower portion of the storage module 28. Upon pumping hydraulic oil 150 at sufficient pressure from the pump device 132, via the hydraulic pipe 140 and onwards into the upper chamber 142*a*, the free-float piston 144 is forced against the liquid sealing mass 151 so as to drive the mass against the plug 156 until the shear pin 160 fails and is severed. Then, the plug 156 and the sealing mass 151 will move out of the bore 154 and onwards into the injection module 30. As such, the pump device 132, the free-float piston 144 and the hydraulic oil 150 constitute a driving means for forcing the sealing mass 151 out of the storage chamber 142*a*, 142*b*.

In an alternative embodiment not shown in the figures, the lower chamber 142*b* of the storage chamber may be filled with a treatment means in the form of a sealing mass being a solid-state material of the fusible type, for example fusible plastics or a suitable metal. In such an alternative embodiment, the lower chamber 142*b* should be connected to a heating device for allowing the solid-state sealing mass to be melted before introduction into said region of the annulus 12 in the well 6. As an alternative in the event that the solid-state sealing mass was melted before placement into the well tool 2, such a heating device may be used for keeping the melted sealing mass in the melted state during conveyance of the tool 2 into the well 6. As mentioned above, the treatment means may also be a well stimulation means or other liquid material. Moreover, the storage module 28 and its storage chamber 142*a*, 142*b* may assume any shape and size suitable for the particular well purpose and/or treatment means.

The injection module 30 (cf. FIGS. 8 and 9) comprises, as viewed in sequence from the upper to the lower end, an axial bore 162; a manifold 164; four manifold conduits 166 (only one of which is shown in the figures); a cylindrical cavity 168; a radially directed partition wall 170 having a central bore 172 and also a ring gasket 174 disposed about the bore 172; and a piston cylinder 176*a*, 176*b* formed at the lower portion of the module 30. Further, the cylinder 176*a*, 176*b* comprises an axially movable piston 178 having a peripheral ring gasket 180, which is in sealing contact with an outer sleeve 182. The outer sleeve 182 defines the piston cylinder 176*a*, 176*b* and said cavity 168 in the module 30. The piston 178 separates the piston cylinder into an upper cylinder chamber 176*a* and a lower piston chamber 176*b*. Furthermore, two hydraulic conduits 184, 186 (shown schematically with dashed lines in FIGS. 8 and 9) are formed within the outer sleeve 182 and are directed onwards to the upper and lower cylinder chamber 176*a*, 176*b*, respectively, on either side of the piston 178. For conveyance of said hydraulic oil 120 onto movable components in the injection module 30, the hydraulic conduits 184, 186 are connected in a flow-communicating manner to, among other things, said hydraulic pipes 126, 128 through the hydraulic oil module 24 and the pump module 26 and also said hydraulic conduits 152, 153 through the storage module 28. The piston 178 in the injection module 30 are also connected to a piston rod 188 extending axially and sealingly upwards through the bore 172 in the partition wall 170 and onwards into the cylindrical cavity 168. At its upper end, the piston rod 188 is provided with an attachment collar 190.

Figure 8:
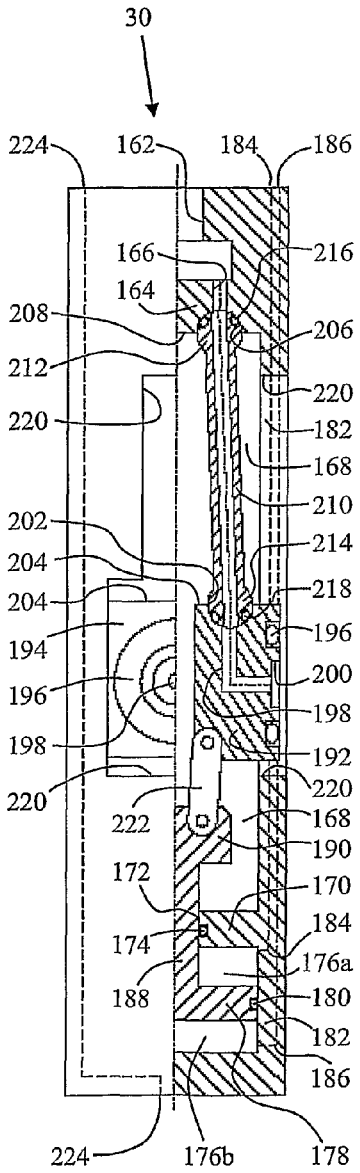
Figure 9:
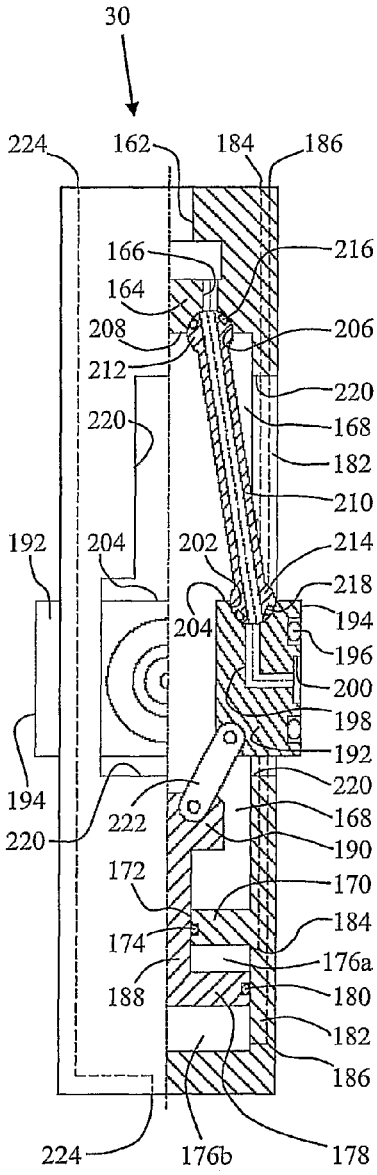

In order to carry out its primary injection function, among other things, the injection module 30 of this exemplary embodiment is provided with four flow-through connection devices in the form of radially movable connection pads 192, only some pads 192 of which are shown in FIGS. 8 and 9. A different, suitable number of connection devices/connection pads may possibly be used in other embodiments (not shown). In this embodiment, however, each connection pad 192 is formed with a peripheral outside surface 194 having a partially circular shape for allowing it to seal closely against the casing 4 upon contact with the casing. For this purpose, the outside surface 194 is also provided with a ring gasket 196, which encloses a central sealing mass conduit 198 ending within a circular recess 200 within the outside surface 194. The sealing mass conduit 198 is connected in flow-communicating manner to a semi-spherical socket 202 formed in an upper side portion 204 of the connection pad 192. A corresponding semi-spherical socket 206 is formed in an upper wall 208 of the cylindrical cavity 168. The socket 206 is connected in flow-communicating manner to a corresponding manifold conduit 166, to the manifold 164 and to the axial bore 162 at the upper portion of the injection module 30. A flow-through ball head joint 210 provides for a movable connection between the upper portion of the injection module 30 and the upper side portion 204 of the connection pad 192. For this purpose, each end of the ball head joint 210 is provided with a flow-through ball head 212, 214 being movably supported in the semi-spherical socket 206 and in the semi-spherical socket 202, respectively. Each ball head 212, 214 is provided with a respective ring gasket 216, 218 for sealing contact with the corresponding socket 206, 202.

Each connection pad 192 may move radially outwards from the cylindrical cavity 168 via a corresponding opening 220 in the outer sleeve 182 of the injection module 30. For this purpose, a hinge joint 222 is disposed between each connection pad 192 and the attachment collar 190 on the piston rod 188. The hinge joint 222 is pivotally attached to the attachment collar 190 and to a lower portion of the connection pad 192.

FIG. 8 shows the axially movable piston 178 of the module 30 when in an inactive position within which the connection pads 192 are retracted into the cavity. FIG. 9, however, shows the piston 178 when in an active position within which the connection pads 192 are extended radially outwards from the cavity 168 via said openings 220 in the outer sleeve 182 of the module 30. The latter is achieved by supplying pressurized hydraulic oil 120 to the lower cylinder chamber 176*b* of the piston cylinder via said hydraulic conduit 186 and said flow connections in the other modules. Retraction of the connection pads 192, however, is achieved by supplying pressurized hydraulic oil 120 to the upper cylinder chamber 176*a* of the piston cylinder via said hydraulic conduit 184 and said flow connections in the other modules.

Further, the axial bore 162 in the upper portion of the injection module 30 corresponds to the axial bore 154 in the lower portion of the storage module 28. When the axially movable piston 178 of the module 30 is in its active position so as to extend the connection pads 192 radially outwards from the cavity 168, said sealing mass 151 may be forced onwards from the storage module 28 and further onwards to and through each connection pad 192. This is achieved by activating said pump device 132 and force the free-float piston 144 of the storage module 28 downwards within the storage chamber 142*a*, 142*b*. By so doing, said plug 156 and the sealing mass 151 are driven out of the bore 154 in the storage module 28 and into the axial bore 162 in the injection module 30 and onwards to the manifold 164 thereof. The plug 156 is captured in the manifold 164, and the sealing mass 151 is distributed to said four manifold conduits 166. The sealing mass 151 flows from each manifold conduit 166 and onwards through the respective ball head joint 210 and the sealing mass conduit 198 in the respective connection pad 192, thereby ending at the circular recess 200 in the outside surface 194 of the pad. This is carried out after having formed a corresponding hole 236 (see FIG. 13) in the casing 4 by means of a perforation device 234, which is operatively connected the injection module 30 via the perforation module 32. In this context, the injection module 30 is also provided with at least one electric wire 224 (shown with a dashed line on FIGS. 8-10) carried onwards into the perforation module 32 for transmission of control signals to said perforation device 234. The control signals emanate from the control module 22 via the intermediate modules 24, 26, 28 and 30.

Figure 10:
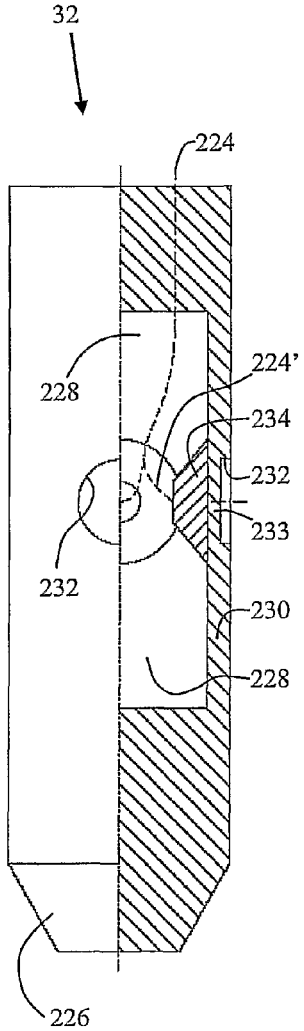
Figure 13:
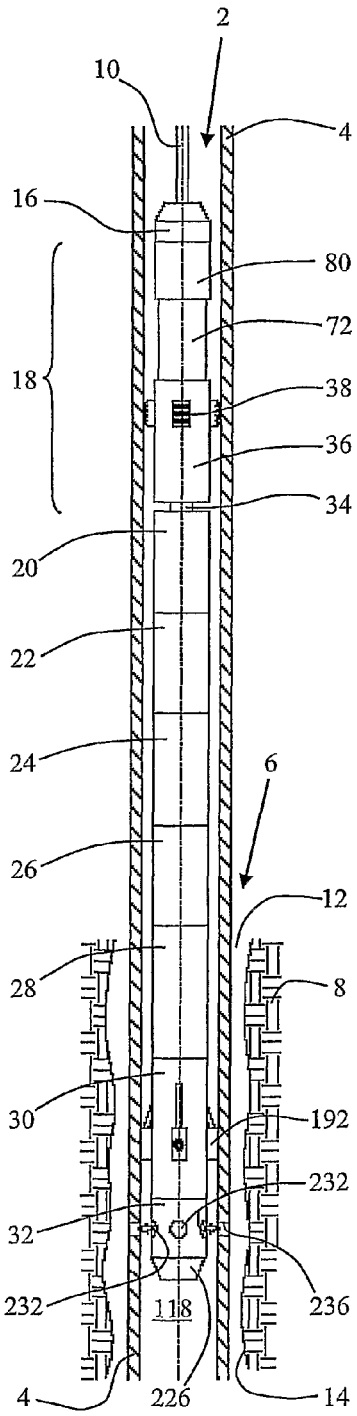

The perforation module 32 (cf. FIG. 10), which is the lowermost module of the well tool 2, has a graduated nose portion 226 for facilitating the conveyance of the well tool 2 into the well 6. The module 32 also comprises a cylindrical cavity 228, which is enclosed by an outer sleeve 230 provided with four recesses 232 in the sleeve 230, only two recesses 232 of which are shown in FIG. 10. The reduced thickness of the sleeve 230 between the recesses 232 and the cavity 228 thus define weakened zones 233 in the outer sleeve 230. An explosive 234, which comprises a so-called shaped charge, is connected to each recess 232 and weakened zone 233. Each explosive 234 is placed against the inside of the respective weakened zone 233 in the outer sleeve 230, each explosive 234 constituting a perforation device. For reception of triggering control signals, each explosive 234 is connected to an electric branch wire 224' from said electric wire 224, which is carried onwards from the injection module 30 and into the cavity 228. Upon triggering, each explosive 234 blasts a directional hole through the corresponding weakened zone 233 and onwards through the casing 4, as shown in FIG. 13.

Hereinafter, reference is made to FIGS. 11-18 for description of various steps in a first embodiment of the present method.

In step (A) of the method, the above-mentioned one-trip well tool 2 is used.

Figure 11:
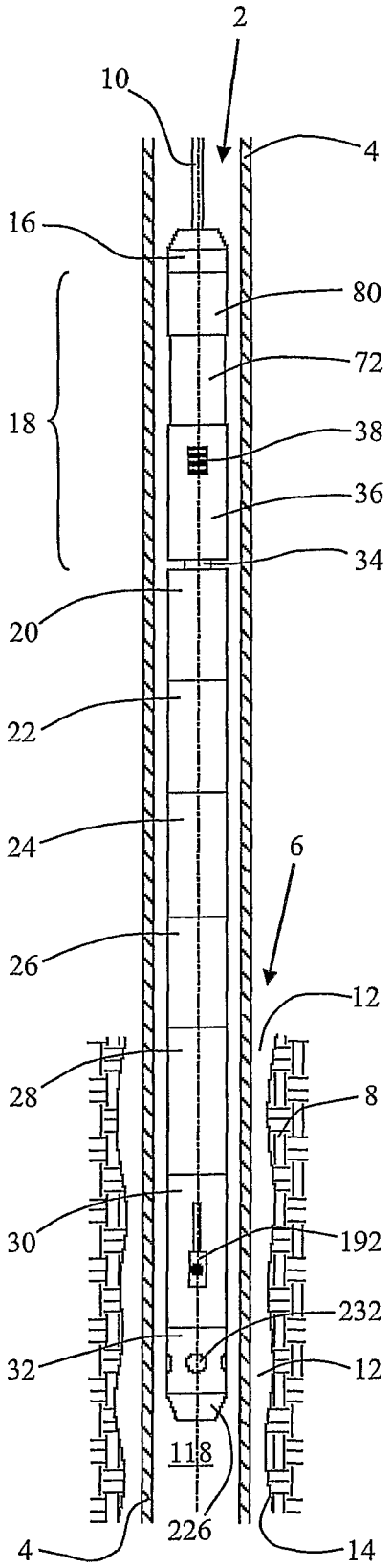
Figure 12:
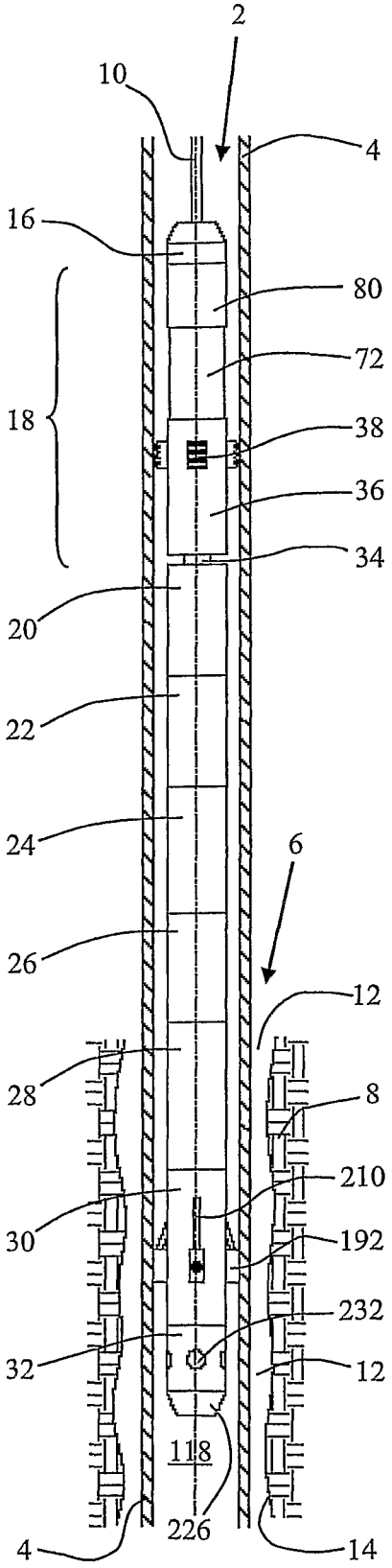

In step (B), and by means of the electric cable 10, the well tool 2 is conveyed into the casing 4 to a location in the well 6 vis-à-vis said region of the annulus 12 to be provided with said liquid sealing mass 151 (cf. FIG. 11).

In step (C) (cf. FIG. 12), the four radially movable gripping elements 38 of the anchoring module 18 are anchored against the inside of the casing 4, as described above (cf. FIG. 3). In this context, and in this embodiment, the four radially movable connection pads 192 of the injection module 30 are also activated and are forced outwards against the casing 4 (cf. FIG. 9). Thus, the well tool 2 is centred in the casing 4. In this step, no injection of said sealing mass 151 via the injection module 30 is carried out.

Figure 14:
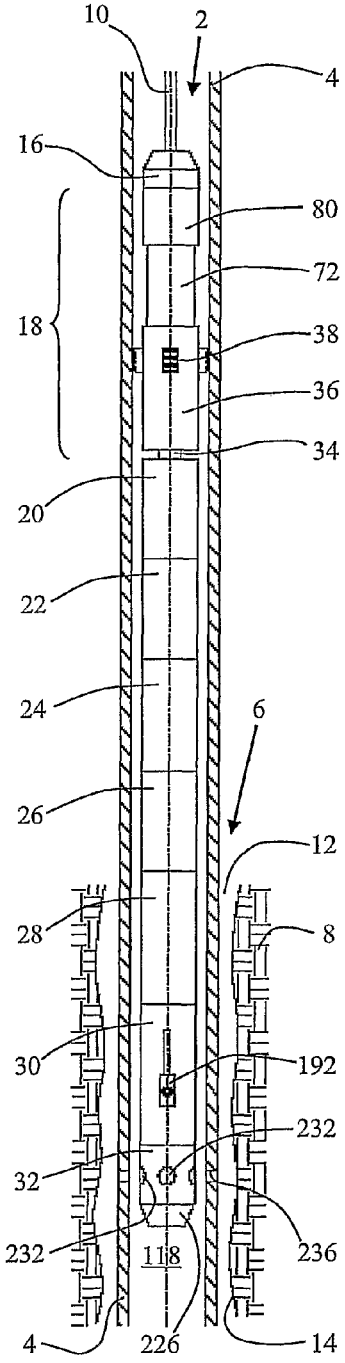

In step (D) (cf. FIG. 13), and by means of the four explosives 234 of the perforation module 32, four corresponding holes 236 are made through the wall of the casing 4, only two holes 236 being shown in FIG. 13. Then, said four radially movable connection pads 192 are deactivated and are retracted into the injection module 30, as shown in FIG. 14.

In step (E) (cf. FIG. 15), the perforation module 32 and its four perforation devices 234 are moved away from the holes 236. This is performed carried out by activating the anchoring module 18 so as to carry out its second function, as described above (cf. FIG. 4). Thereby, the second part 80 of the anchoring module 18 is moved in the axial direction downwards so as to axially compress said coiled hydraulic pipes 74, 76, among other things. As mentioned above, this axial movement also provides for simultaneous axial movement of the associated, massive piston rod 34 and, thus, all the other modules 20, 22, 24, 26, 28, 30, 32 in the well tool 2.

Figure 15:
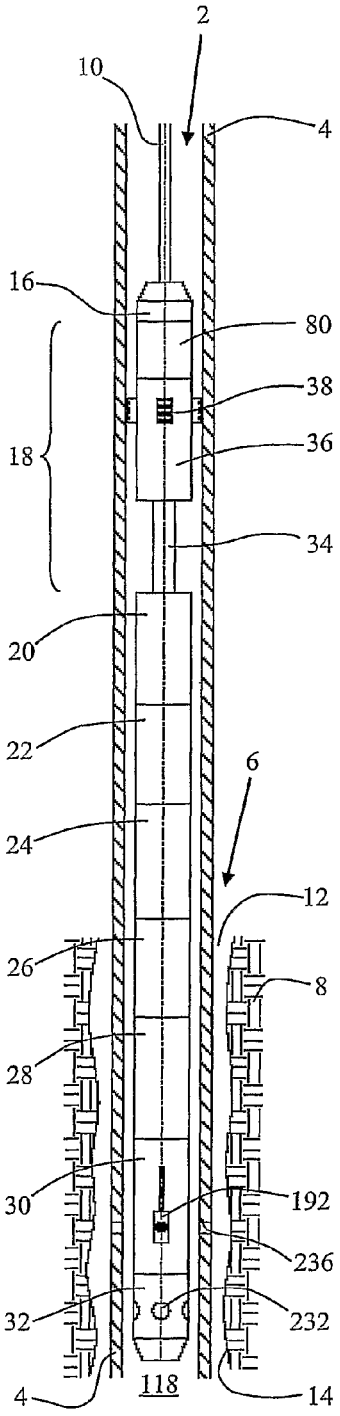
Figure 16:
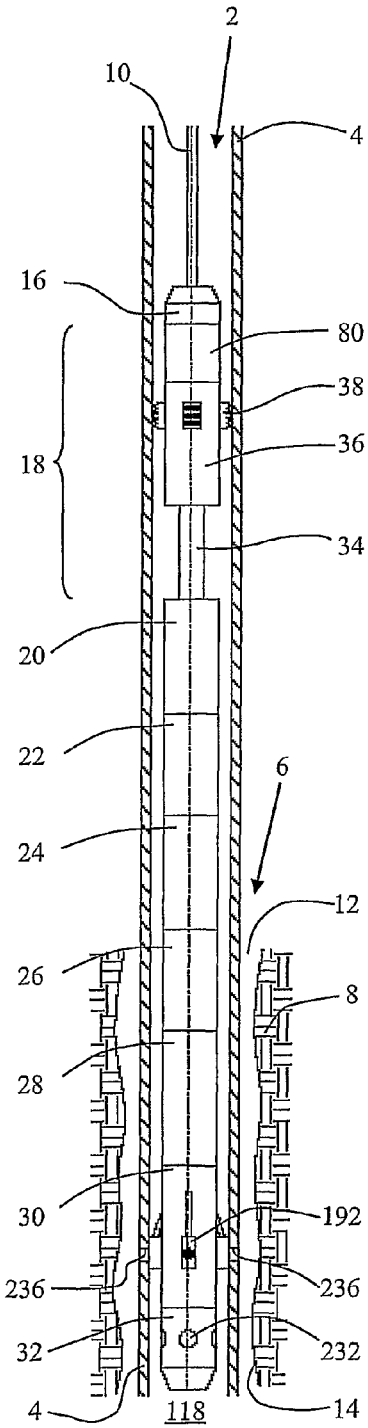

Thereby, as stated in step (F), also the four radially movable connection pads 192 of the injection module 30 are moved to a position in vicinity of the respective hole 236. In FIG. 15, the connection pads 192 are shown in a retracted position within the injection module 30.

In the well tool 2, the connection pads 192 in the injection module 30 and the respective perforation devices 234 in the perforation module 32 are aligned with respect to each other, and at an axial distance corresponding to the stroke of said massive piston rod 34 in the anchoring module 18. This arrangement thus constitutes, as stated in step (G), an alignment means which allows the connection pads 192 to be aligned vis-à-vis the respective holes 236.

In step (H) (cf. FIG. 16.), the connection pads are connected in flow-communicating manner to the respective holes 236. This happens in the same manner as described above in context of FIGS. 9 and 12.

Figure 17:
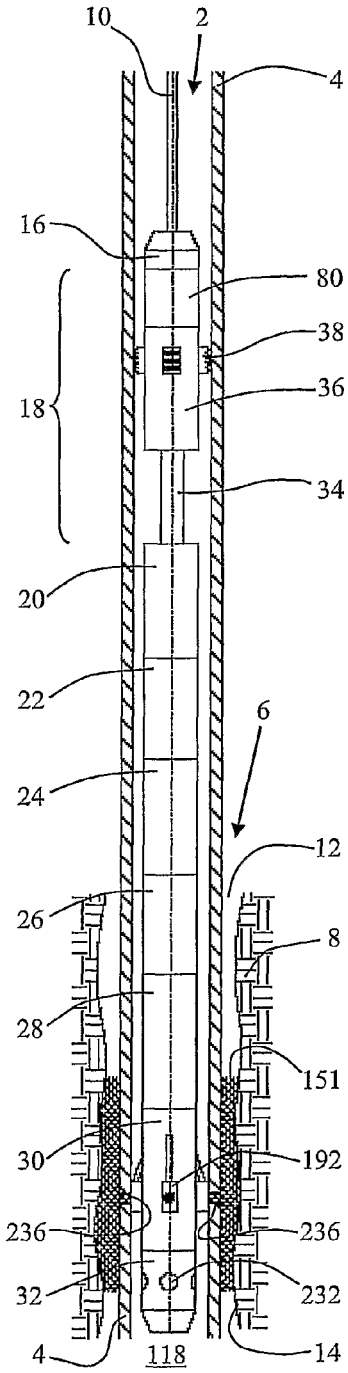

In step (I), liquid sealing mass 151 is forced out of the storage chamber 142*a*, 142*b* and is injected into said region of the annulus 12 via the connection pads 192 and the holes 236 in the casing 4, as shown in FIG. 17. Thereby, the sealing mass 151 is placed into the annulus 12. This is carried out by means of the pump device 132 in the hydraulic pump module 26, the free-flow piston 144 in the storage module 28 and the hydraulic oil 150, which collectively constitute a driving means for the sealing mass 151.

Figure 18:
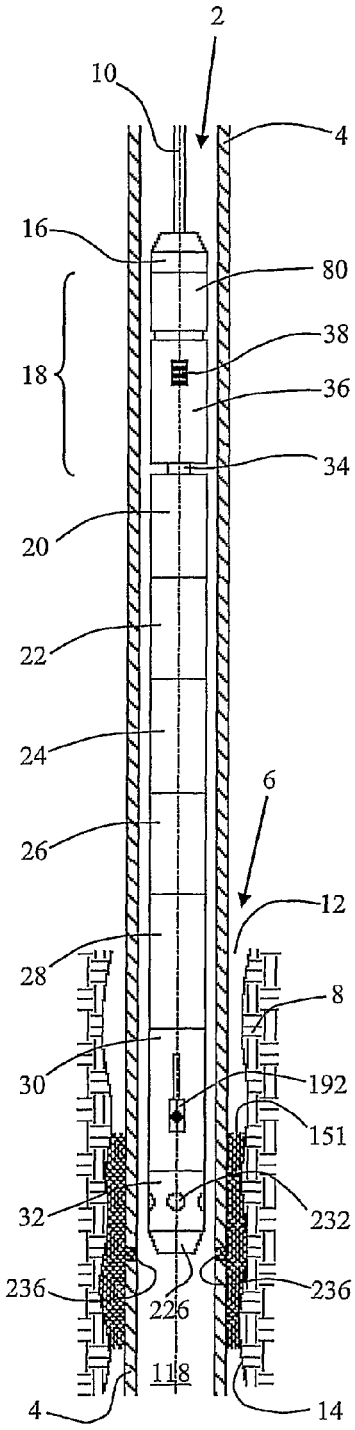

Finally, and in step (J), the connection pads 192 (in the injection module 30) and the gripping elements 38 (in the anchoring module 18) of the well tool 2 are disconnected from the casing 4, after which the well tool 2 is pulled out of the well 6, as shown in FIG. 18.

Exemplary Embodiment No. 2

FIGS. 19-21 show main constituents of a two-trip well tool according to the invention comprising two releasable tool assemblies, including a first tool assembly 302*a* and a second tool assembly 302*b*. FIGS. 22-24 show details of two main constituents of the well tool 302*a*, 302*b*. FIGS. 25-33 show various steps of a second embodiment of the present method. In this embodiment, the two-trip well tool 302*a*, 302*b* is used in said casing 4 in the well 6. Some of the main constituents in the well tool 302*a*, 302*b* are identical to the main constituents in the one-trip well tool 2, whereas other constituents are new or modified relative to that shown for the well tool 2.

In this context it is mentioned that the well tool 302*a*, 302*b*, in another exemplary embodiment (not shown), just as well may be used to force a treatment means, for example the sealing mass 151, into a region of an annulus located between two casings of different diameters, or similar pipe structures.

The two-trip well tool 302*a*, 302*b* comprises the following main constituents from the one-trip well tool 2: the connector 16 onto which the electric cable 10 is connected; the valve module 20; the control module 22; the hydraulic oil module 24; the hydraulic pump module 26; the storage module 28. Additionally, the well tool 302*a*, 302*b* comprises a running tool 304, an anchoring module 318; an injection module 330; and a perforation module 332. FIGS. 22-24 show further details of the anchoring module 318 and the injection module 330. All of the anchoring module 318, the injection module 330 and the perforation module 332 are modified with respect to the corresponding modules 18, 30 and 32 in the one-trip well tool 2.

In this embodiment, the anchoring module 318, the perforation module 332 and the injection module 330 are structured as separate modules, wherein both the perforation module 332 and the injection module 330 are structured in a manner allowing them to be releasably connected to the anchoring module 318. Thereby, both the perforation module 332 and the injection module 330 are movable relative to the anchoring module 318. This is of significance for the use of the two-trip well tool 302*a*, 302*b* in the well 6.

In context of the first trip down into the well 6, the first tool assembly 302*a* of the well tool is conveyed into the casing 4. As viewed from above and downwards, this first tool assembly 302*a* comprises the connector 16, the running tool 304, the perforation module 332 and the anchoring module 318, as shown in FIG. 19.

In this context, the running tool 304 constitutes a simplified combination tool replacing many of the functions described for the above-mentioned valve module 20, control module 22, hydraulic oil module 24 and hydraulic pump module 26. The running tool 304 is therefore structured in a manner allowing it to transmit suitable motive power and control signals for operation of both the perforation module 332 and the anchoring module 318. The construction and the function of the running tool 304 will not be described in further detail here given that its function and mode of operation has been discussed via the description of said modules 20, 22, 24 and 26. Running tools are also considered to constitute prior art given that they exist in different variants for use in context of various downhole operations in a well.

Figure 28:
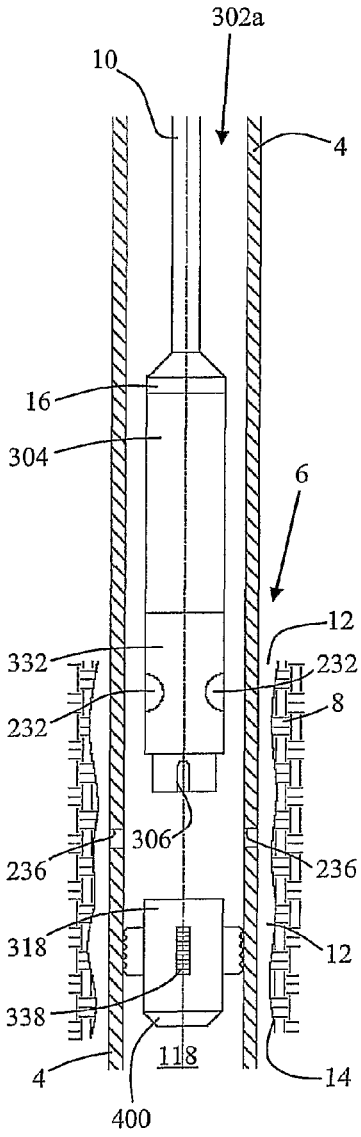
Figure 29:
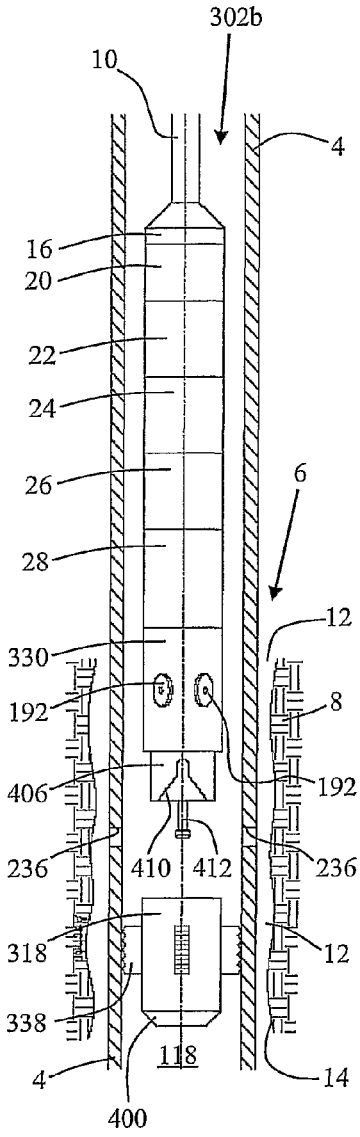
Figure 30:
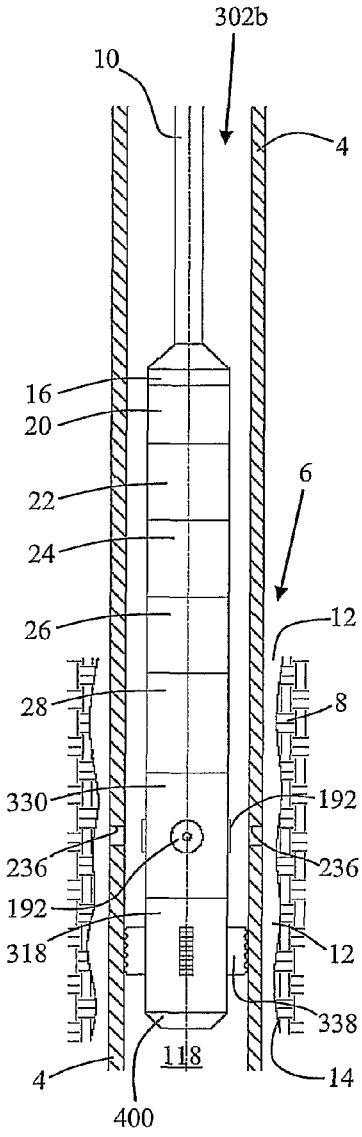

Neither the perforation module 332 (cf. FIG. 19) will be discussed in detail given that it represents a modification of the perforation module 32 in the one-trip well tool 2. Similar to the module 32, the present perforation module 332 comprises four recesses 232, weakened zones 233 and explosives 234 having shaped charges as well as associated electric wires connected to the running tool 304 for controlled detonation of the explosives 234 via the electric cable 10. The perforation module 332 is also structured for connection between the running tool 304 and the anchoring module 318. Various hydraulic lines are also carried through the perforation module 332 for conveyance of hydraulic oil onto movable components in the anchoring module 318; which is similar to that described in context of the perforation module 32. Moreover, a lower portion of the perforation module 332 is provided with two external, axially directed orientation tracks 306 (cf. FIG. 28 showing only one orientation track 306). The orientation tracks 306 are structured for releasable connection to corresponding orientation pins 308 (cf. FIGS. 23 and 24) disposed internally in the anchoring module 318. Furthermore, a lower portion of the injection module 330 is provided with two external, Y-shaped orientation tracks 410 (cf. FIGS. 22 and 29) structured for releasable connection to said corresponding orientation pins 308 in the anchoring module 318. In this exemplary embodiment, the orientation tracks 306 (and 410) as well as the orientation pins 308 are disposed diametrically opposite of each other.

An orientation pin 308 thus constitutes a first orientation means, whereas an orientation track 306, 410 constitutes a second orientation means in an orientation instrument for the well tool 302. If desirable, the orientation means may be exchanged, such that the orientation track 306, 410 constitutes the first orientation means, whereas the orientation pin 308 constitutes the second orientation means. Such a orientation track may also have another shape, for example a helical shape into which an orientation pin or similar is screwed into upon insertion into the orientation track.

With respect to the perforation module 32, the orientation elements 306 and 308 have already been assembled at surface before said first tool assembly 302*a* is run into the casing 4. With respect to the injection module 30, however, the orientation elements 410 and 308 are first assembled down in the well 6, which will be explained hereinafter.

Now the anchoring module 318 will be explained in further detail (cf. FIGS. 23 and 24). As mentioned, the anchoring module 318 represents a modification of the preceding anchoring module 18, which has both an anchoring function and a movement function. The object of the movement function is to move the massive piston rod 34, and hence most of the well tool 2, in the axial direction after anchoring of the module 18. The only function of the present anchoring module 318, however, is to anchor a lower portion of the well tool 302*a*, 302*b* against the inner pipe wall of the casing 4, which is carried out in context of said first trip down into the well 6. For this reason, the anchoring module 318 lacks the elements causing axial movement of said piston rod 34 in the anchoring module 18.

Thus, and similar to the module 18, the anchoring module 318 comprises four radially movable gripping elements 338 disposed within a recessed cavity 340. Each gripping element 338 is provided with external gripping teeth 342 as well as two hinge joints 344, 346 disposed pivotally at an upper and lower axial portion, respectively, of the gripping element 338. The lower hinge joint 346 is pivotally connected to a fixed lower wall 348 of the recessed cavity 340, whereas the upper hinge joint 344 is pivotally connected to a lower portion of an axially movable guide sleeve 350. The guide sleeve 350 is axially movable along the inside of an outer sleeve portion 352, which defines a cylindrical cavity 354. A release sleeve 356 having an upper collar 358 is disposed on the inside of the guide sleeve 350. The collar 358 is attached to the guide sleeve 350 by means of a shear pin 360, the function of which will be discussed in further detail in the following, and in context of the injection module 330. The internal release sleeve 356 also comprises a graduated lower portion 362, the circumference of which is provided with several radially and outwardly directed, spring-loaded locking dogs 364. By means of the locking dogs 364, the lower portion 362 of the release sleeve 356 is releasably attached to the inside of a graduated upper portion 366 of an axially directed piston rod 334. The locking dogs 364 are carried through corresponding openings 368 in the upper portion 366 of the piston rod 334 and onwards into a corresponding and ring-shaped locking groove 370 formed on the inside of the guide sleeve 350. Thereby, the upper portion 364 of the piston rod 334 is located between the lower portion 362 of the release sleeve 356 and the guide sleeve 350.

Further, a ring-shaped piston 386 is fixed to the outside of the piston rod 334 and extends outwards onto an outer sleeve portion 388 of a piston cylinder 384*a*, 384*b* formed at a lower portion of the anchoring module 318. Thereby, the piston 386 separates the piston cylinder into an upper cylinder chamber 384*a* and a lower cylinder chamber 384*b*. A hydraulic conduit 390 (shown schematically with a dashed line in FIGS. 23 and 24) is carried through the outer sleeve portions 352 and 388 and are directed onwards to the upper cylinder chamber 384*a* for supply of hydraulic oil from the running tool 304. If desirable or required, the outer sleeve portions 352, 388 may also be provided with a further hydraulic conduit directed onwards to the lower cylinder chamber 384*b* for supply of said hydraulic oil. Additionally, respective ring gaskets 392, 394 are disposed at the upper end of the piston cylinder 384*a*, 384*b* and at the periphery of the piston 386, respectively. The ring gaskets 392, 394 are in sealing contact with the piston rod 334 and the outer sleeve portion 388, respectively. Moreover, a narrower piston portion 396 of the piston rod 334 extends downwards and onwards into a bore 398 disposed at the lower end of the anchoring module 318. This lower end is also formed with a graduated nose portion 400 for facilitating the conveyance of the first too assembly 302*a* of the well tool 302 into the well 6.

At an upper portion of the anchoring module 318, and at the inside of said outer sleeve portion 352, a ring-shaped locking groove 402 facing into the cavity 354 is also formed. Additionally, said orientation pins 308 (only one pin 308 of which is shown in FIG. 23) extend into the cavity 354 at the lower side of the locking groove 402. Both the orientation pins 308 and the locking groove 402 are structured for releasable engagement with corresponding elements in the perforation module 32 and the injection module 330, which will be described in further detail when discussing the injection module 330.

FIG. 23 shows the anchoring module 318 when in an inactive position within which the gripping elements 338 are retracted into the recessed cavity 340 in the module 318, whereas FIG. 24 shows the ring-shaped piston 386 when in an active position within which the gripping elements 338 are extended radially outwards from the cavity 340. The latter is achieved by supplying pressurized hydraulic oil to said upper cylinder chamber 384*a* via the hydraulic conduit 390. Thereby, the piston 386 is driven in the axial direction downwards and pulls along the guide sleeve 350 via the release sleeve 356 and the shear pin 360. This forces the gripping elements 338 radially outwards via said two hinge joints 44, 46, as shown in FIG. 24. Simultaneously, the narrower piston portion 396 of the piston rod 334 will move downwards within said bore 398 in the lower portion of the anchoring module 318. Thereby, a longitudinal portion of the piston portion 396 will move through a ratch ring 404 disposed about an upper portion of the bore 398. The ratchets in the ratch ring 404 are of form whereby they allow downward movement but resist upward movement of the piston portion 396. This resistance to upward movement of the piston portion 396 provides for a good and secure anchoring of the gripping elements 338 against the inner pipe wall of the casing 4.

Hereinafter, reference is made to FIGS. 22 and 24 for further description of the injection module 330. As mentioned, the injection module 330 represents a modification of the previously discussed injection module 30. The injection module 330 also has two functions. The first function is to carry out injection of said liquid sealing mass 151 into said region of the annulus 12. The second function is to carry out a controlled and releasable connection to the anchoring module 318 in context of a second trip down into the well 6, in which context the injection module 330 constitutes a part of said second tool assembly 302*b* (cf. FIG. 21) of the well tool 302. The latter will be explained in further detail hereinafter.

In order to carry out said first function in the well 6, the injection module 330 comprises all constituents from the injection module 30. These constituents have the same construction and mode of operation as described in context of the injection module 30. In FIGS. 22 and 24, these constituents are therefore given the same reference numerals as those of the injection module 30.

In order to carry out said second function in the well 6, the injection module 330 also comprises a connection unit 406 structured for controlled and releasable connection to the anchoring module 318. An upper portion of the connection unit 406 comprises an external, ring-shaped lock ring 408 structured for releasable connection to said ring-shaped locking groove 402 at the inside of the outer sleeve portion 352 in the anchoring module 318. This upper portion also comprises said external and Y-shaped orientation tracks 410, which are structured for controlled reception of said orientation pins 308 at the inside of the outer sleeve portion 352. This is equivalent to the corresponding orientation means in the perforation module 332.

In order to assist the insertion and the releasable connection within the anchoring module 318, the lower portion of the connection unit 406 is comprised of an axially directed and releasable anchoring shaft 412. At its outer and free end, the anchoring shaft 412 is provided with a connector head 414 having a lock ring 416 comprised of radially biased and axially directed locking segments 416*a* which, at an inner end thereof, are fixed to the shaft 412, and which, at an outer and free end thereof, are provided with respective locking dogs 416*b*. The anchoring shaft 412 also comprises a narrower longitudinal portion forming an axially directed depression 418 within which the locking segments 416*a* and the locking dogs 416*b* may flex radially inwards and outwards in context of connection to or from the anchoring module 318.

FIG. 24 shows the injection module 330 and the anchoring module 318 when connected, wherein said connection pads 192 in the injection module 330 and said gripping elements 338 in the anchoring module 318 are shown when in their active and radially extended positions. The figure also shows the anchoring shaft 412 inserted into the guide sleeve 350 and the release sleeve 356 in the anchoring module 318. In this position the connector head 414 and the lock ring 416 have been inserted past the collar 358 of the release sleeve 356 so as to be in locking engagement with the inside of the release sleeve 356. Simultaneously, the ring-shaped lock ring 408 on the outside of the injection module 330 are positioned in releasable engagement within the ring-shaped locking groove 402 in the upper portion of the anchoring module 318, whereas the orientation pins 308 in the anchoring module 318 have been guided into the Y-shaped orientation tracks 410 on the outside of the injection module 330. By means of said orientation means, the connection pads 192 of the injection module 330 may be aligned vis-à-vis holes 236, which have been formed through the wall of the casing 4 by the perforation module 32. For this reason, the connection pads 192 in the injection module 330 and the explosives 234 in the perforation module 332 are disposed at an equal distance from a given point on the anchoring module 318, for example from the gripping elements 338.

After the injection module 330 has injected the sealing mass 151 into said region of the annulus 12, the injection module 330 may be released from the anchoring module 318 by pulling the connection unit 406 on the injection module 330 out of the anchoring module 318. This is carried out by pulling the electric cable 10 upwards using a sufficient release force. In this context, said shear pin 360 will be severed, and said spring-loaded locking dogs 364 will be forced out of their locking groove 370 in the guide sleeve 350. Thereby, the release sleeve 356 will be released from the guide sleeve 350 in the anchoring module 318 and, due to said collar 358 on the release sleeve 356 as well as said lock ring 416 on the anchoring shaft 412, will follow the anchoring shaft 412 when being pulled out of the anchoring module 318. The latter is not shown in any figures.

Hereinafter, reference is made to FIGS. 25-33 for description of various steps in a second embodiment of the present method.

In step (A) of the method, the above-mentioned two-trip well tool 302*a*, 302*b* is used.

Figure 25:
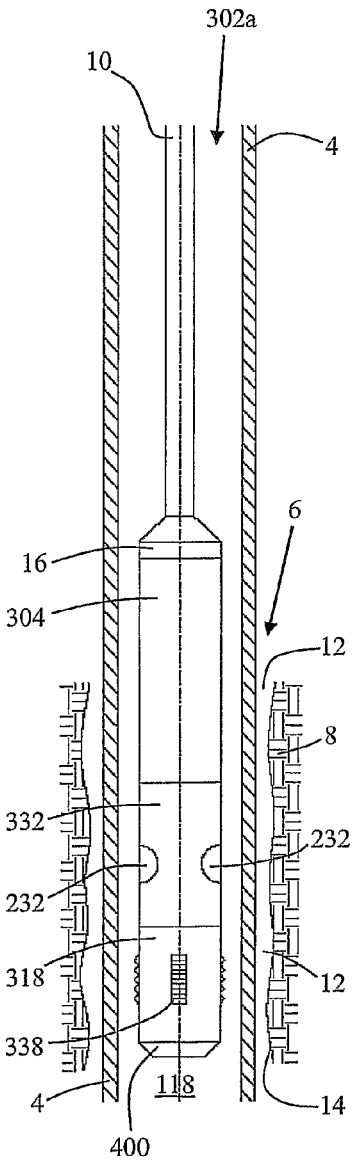
Figure 26:
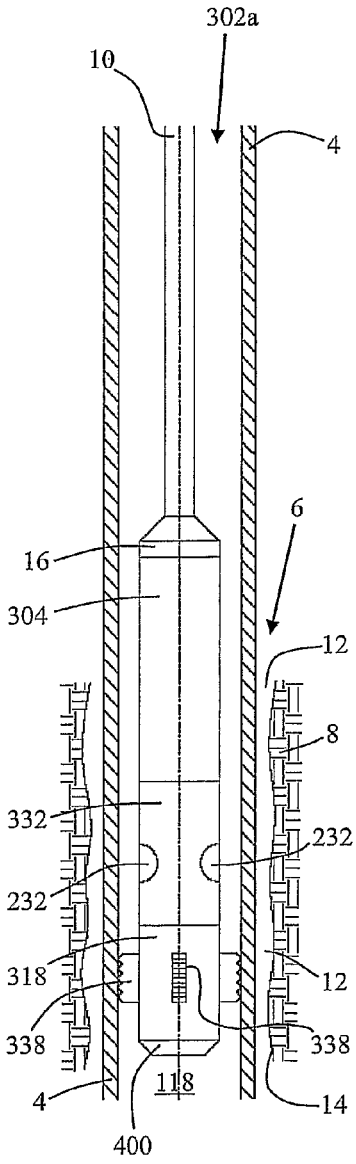

In step (B), and by means of the electric cable 10, the well tool's first tool assembly 302*a*, which is releasable, is conveyed into the casing 4 to a location in the well 6 vis-à-vis said region of the annulus 12 to be provided with said liquid sealing mass 151 (cf. FIG. 25).

In step (C) (cf. FIG. 26), the four radially movable gripping elements 338 of the anchoring module 318 are anchored against the inside of the casing 4, as described above (cf. FIG. 23).

Figure 27:
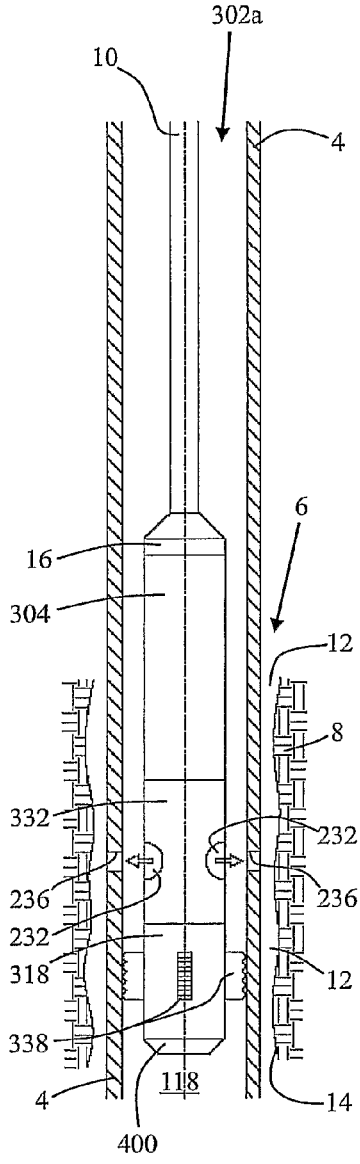

In step (D) (cf. FIG. 27), and by means of the four explosives 234 of the perforation module 332, four corresponding holes 236 are made through the wall of the casing 4, only two holes 236 being shown in FIG. 27.

In step (E) (cf. FIG. 28), the perforation module 332 is pulled out of the set anchoring module 318 by means of the electric cable 10, whereby the perforation module 332 is moved away from the holes 236. Then the perforation module 332 and the running tool 304 are pulled out of the well 6.

In step (F) (cf. FIG. 29), the well tool's second tool assembly 302*b* is conveyed into the casing 4 by means of the electric cable 10. This tool assembly 302*b* comprises, in addition to the injection module 330, several constituents corresponding to constituents in the well tool 2. In FIGS. 21 and 29-33, these constituents are therefore given the same reference numerals as those of the well tool 2. These constituents are comprised of the connector 16, the valve module 20, the control module 22, the hydraulic oil module 24, the hydraulic pump module 26 and the storage module 28. The constituents 16, 20, 22, 24, 26 and 28 have the same construction and mode of operation as described in context of the well tool 2. Thereby, also the connection pads 192 of the injection module 330 are moved down to a position in vicinity of the holes 236.

In step (G) (cf. FIG. 30), and by means of the electric cable 10, among other things, the injection module 330 is connected releasably to the set anchoring module 318. Thereby, the connection pads 192 of the injection module 330 are aligned vis-à-vis the holes by means of said Y-shaped orientation tracks 410 on the outside of the injection module 330 and said orientation pins 308 in the anchoring module 318. These orientation elements 410, 308 constitute alignment means for correct positioning of the connection pads 192 relative to the holes 236.

In step (H) (cf. FIG. 31), the connection pads 192 are connected in a flow-communicating manner to respective holes 236 through the wall of the casing 4. This is carried out by activating the connection pads 192 hydraulically so as to move them radially outwards from the injection module 330 until contact with the wall of the casing 4, and in a manner whereby the connection pads 192 engage pressure-sealingly around the respective holes 236. This is described in detail above.

In step (I) (cf. FIG. 32), the liquid sealing mass 151 is forced out of the storage chamber 142*a*, 142*b* in the storage module 28. This is carried out by means of said pump device 132 in the hydraulic pump module 26 and the free-flow piston 144 in the storage module 28. Thus, the pump device 132, the free-flow piston 144 and the hydraulic oil 150 constitute a driving means operatively connected to the injection module 330. By means of this driving means, the liquid sealing mass 151 is injected into said region of the annulus 12 via the connection pads 192 and the holes 236, whereby the sealing mass 151 is placed into the annulus 12.

Finally, in step (J) (cf. FIG. 32), the connection pads 192 are disconnected from the casing 4. Then the second tool assembly 302*b* and the anchoring module 318 are pulled out of the well 6.

The invention claimed is:

1. A well tool for in situ introduction of a liquid treatment substance into a region of an annulus located outside a pipe structure in a well, the well tool comprising:

at least one anchoring body for anchoring against an inside of the pipe structure;

at least two perforation devices for forming at least two holes through a wall of the pipe structure;

at least one storage chamber for storing the liquid treatment substance;

at least one driving device for forcing the liquid treatment substance out of the storage chamber;

at least two flow-through connection devices connected in a flow-communicating manner to the storage chamber and structured such that the at least two flow-through connection devices are connectable in a flow-communicating manner to said at least two holes through the wall of the pipe structure for injection of the liquid treatment substance into said region of the annulus, wherein the well tool is structured for receiving energy and control signals for operation of the well tool, wherein said anchoring body is disposed in an anchoring module, wherein at least said storage chamber, said driving device, and said connection devices are operatively connected to an injection module, wherein the injection module is structured such that the injection module is axially movable relative to the anchoring module, thereby allowing the connection devices to be moved to a position in vicinity of said at least two holes after the forming of said at least two holes, and wherein the well tool comprises at least one alignment device for alignment of the connection devices vis-à-vis the at least tow holes through the wall of the pipe structure for connection to the at least two holes and subsequent injection of the liquid treatment substance into said region of the annulus.

2. The well tool according to claim 1, wherein the well tool is structured for conveyance into the pipe structure via a connection line.

3. The well tool according to claim 1, wherein:

said perforation devices are also operatively connected to the injection module, wherein the injection module is connected in an axially movable manner to the anchoring module, wherein the injection module is movable relative to the anchoring module, and wherein the injection module is non-rotatably connected to the anchoring module, the non-rotatable connection constituting an alignment device for axial alignment of the connection devices relative to said at least two holes through the wall of the pipe structure.

4. The well tool according to claim 3, wherein the injection module is movably connected to a rotation-preventing guide device associated with the anchoring module.

5. The well tool according to claim 3, wherein the injection module and the anchoring module are connected in an axially movable manner via at least one connection body.

6. The well tool according to claim 5, wherein:

the connection body is comprised of an axially movable piston rod, and wherein a first end of the piston rod is operatively connected to a piston in a cylinder disposed in the anchoring module, and a second end of the piston rod extends outwardly from the cylinder and is operatively connected to the injection module, wherein the injection module is axially movable upon movement of the piston.

7. The well tool according to claim 5, wherein the axially movable connection body is non-rotatably connected to the anchoring module, the non-rotatable connection body constituting an alignment device for axial alignment of the connection devices relative to said at least two holes through the wall of the pipe structure.

8. The well tool according to claim 1 wherein the liquid treatment substance is comprised of one of a sealing mass and a well stimulation substance.

9. A method for in situ introduction of a liquid treatment substance into a region of an annulus located outside a pipe structure in a well, the method comprising the following steps:

(A) providing a well tool according to claim 1;

(B) conveying at least the anchoring module and said perforation devices into the pipe structure to a location vis-à-vis said region of the annulus;

(C) anchoring the at least one anchoring body of the anchoring module against the inside of the pipe structure;

(D) using said perforation devices; making the at least two holes through the wall of the pipe structure;

(E) moving the perforation devices away from said at least two holes through the wall of the pipe structure;

(F) moving said connection devices, which are operatively connected to the injection module, to a position in vicinity of said at least two holes through the wall of the pipe structure;

(G) using the at least one alignment device of the well tool, aligning the connection devices vis-à-vis said at least two holes through the wall of the pipe structure;

(H) connecting the connection devices in a flow-communicating manner to said at least two holes through the wall of the pipe structure;

(I) using said driving device operatively connected to the injection module, forcing the liquid treatment substance out of the storage chamber for injection of the liquid treatment substance into said region of the annulus via the connection devices and said at least two holes through the wall of the pipe structure, thereby placing the liquid treatment substance into the annulus and further sealing said at least two holes with the liquid treatment substance, wherein said liquid treatment substance is comprised of a sealing mass; and (J) disconnecting the well tool from the pipe structure and pulling the well tool out of the well.

10. The method according to claim 9, wherein, in step (B), the method comprises the step of conveying the well tool into the pipe structure using a connection line.

11. The method according to claim 9, wherein the method also comprises the following steps:

before step (B), operatively connecting said perforation devices to the injection module and connecting the injection module in an axially movable and non-rotatable manner to the anchoring module so as to form an assembly thereof;

in step (B), conveying the assembly of the injection module and the anchoring module into the pipe structure to said location vis-à-vis said region of the annulus;

in step (D), using the perforation devices of the injection module, making said at least two holes through the wall of the pipe structure; and in step (E) and (F), moving the injection module axially relative to the anchoring module, thereby simultaneously moving the connection devices of the injection module to a position in vicinity of said at least two holes, the non-rotatable connection constituting an alignment device for axial alignment of the connection devices relative to said at least two holes.

12. The well tool according to claim 1, wherein said perforation devices are explosives.

13. A well tool for in situ introduction of a liquid treatment substance into a region of an annulus located outside a pipe structure in a well, the well tool comprising:

at least one anchoring body for anchoring against an inside of the pipe structure;

at least one perforation device for forming at least one hole through a wall of the pipe structure;

at least one storage chamber for storing the liquid treatment substance;

at least one driving device for forcing the liquid treatment substance out of the storage chamber;

at least one flow-through connection device connected in a flow-communicating manner to the storage chamber and structured such that the at least on flow-through connection device is connectable in a flow-communicating manner to said at least one hole through the wall of the pipe structure for injection of the liquid treatment substance into said region of the annulus, wherein the well tool is structured for receiving energy and control signals for operation of the well tool, wherein said anchoring body is disposed in an anchoring module, wherein at least said storage chamber, said driving device, and said connection device are operatively connected to an injection module, wherein the injection module is structured such that the injection module is axially movable relative to the anchoring module, thereby allowing the connection device to be moved to a position in vicinity of said at least one hole after the forming of said at least one hole, wherein the well tool comprises at least one alignment device for alignment of the connection device vis-à-vis the at least one hole through the wall of the pipe structure for connection to the at least one hole and subsequent injection of the liquid treatment substance into said region of the annulus, wherein said perforation device is operatively connected to a perforation module, wherein the anchoring module, the perforation module and the injection module are structured as separate modules, wherein both the perforation module and the injection module are structured such that the perforation module and the injection module are releasably connectable to the anchoring module, wherein both the perforation module and the injection module are movable relative to the anchoring module, wherein the well tool further comprises an orientation instrument including a first orientation device and a second orientation device, wherein the second orientation device is structured such that the second orientation device is releasably connectable to, and positioned relative to, the first orientation device, wherein the anchoring module is provided with the first orientation device, wherein the perforation module and the injection module are each provided with a second orientation device, and wherein the first orientation device of the anchoring module is configured to receive the second orientation device of the injection module such that the connection device is aligned with said at least one hole through the wall of the pipe structure.

14. A method for in situ introduction of a liquid treatment substance into a region of an annulus located outside a pipe structure in a well, the method comprising the following steps:

(A) providing a well tool comprising:

at least one anchoring body for anchoring against an inside of the pipe structure;

at least one perforation device for forming at least one hole through a wall of the pipe structure;

at least one storage chamber for storing the liquid treatment substance;

at least one driving device for forcing the liquid treatment substance out of the storage chamber.

at least one flow-through connection device connected in a flow-communicating manner to the storage chamber and structured such that the at least one flow-through connection device is connectable in a flow-communicating manner to said at least one hole through the wall of the pipe structure for injection of the liquid treatment substance into said region of the annulus, wherein the well tool is structured for receiving energy and control signals for operation of the well tool, wherein said anchoring body is disposed in an anchoring module, wherein at least said storage chamber, said driving device, and said connection device are operatively connected to an injection module, wherein the injection module is structured such that the injection module is axially movable relative to the anchoring module, thereby allowing the connection device to be moved to a position in vicinity of said at least one hole after the forming of said at least one hole, wherein the well tool comprises at least one alignment device for alignment of the connection device vis-à-vis the at least one hole through the wall of the pipe structure for connection to the at least one hole and subsequent injection of the liquid treatment substance into said region of the annulus;

(B) operatively connecting said perforation device to a perforation module, structuring the anchoring module, the perforation module and the injection module as separate modules, and structuring both the perforation module and the injection module such that the perforation module and the injection module are releasably connectable to the anchoring module;

(C) conveying a releasable assembly of the anchoring module and the perforation module into the pipe structure to said location vis-à-vis said region of the annulus;

(D) anchoring the at least one anchoring body of the anchoring module against the inside of the pipe structure;

(E) using the perforation device of the perforation module, making said at least one hole through the wall of the pipe structure;

(F) moving the perforation device away from said at least one hole through the wall of the pipe structure, and disconnecting the perforation module from the set anchoring module and pulling the perforation module out of the well, thereby moving said perforation device away from said at least one hole through the wall of the pipe structure;

(G) conveying the injection module into the pipe structure and releasably connecting the injection module to the set anchoring module, thereby simultaneously moving said connection device, which is operatively connected to the injection module, to a position in vicinity of said at least one hole through the wall of the pipe structure and using the at least one alignment device of the well tool, aligning the connection device vis-à-vis said at least one hole through the wall of the pipe structure;

(H) connecting the connection device in a flow-communicating manner to said at least one hole through the wall of the pipe structure;

(I) using said driving device operatively connected to the injection module, forcing the liquid treatment substance out of the storage chamber for injection of the liquid treatment substance into said region of the annulus via the connection device and said at least one hole through the wall of the pipe structure, thereby placing the liquid treatment substance into the annulus; and (J) disconnecting the well tool from the pipe structure and pulling the well tool out of the well.

* * * * *